US005809379A

United States Patent [19]

Yano et al.

[11] Patent Number: 5,809,379

[45] Date of Patent: Sep. 15, 1998

[54] ELECTROPHOTOGRAPHY HAVING PHOTOSENSITIVE MEMBER WITH CHARGE BLOCKING OVERLAYER

[75] Inventors: Hideyuki Yano, Yokohama; Yasushi Sato, Kawasaki; Junji Araya, Yokohama; Yukihiro Ohzeki, Tokyo; Harumi Kugoh, Kawasaki; Katsuhiro Sakaizawa, Tokyo; Tadashi Furuya; Osamu Iwasaki, both of Yokohama, all of Japan

[73] Assignee: Canon Kabushiki Kaisha, Tokyo, Japan

[21] Appl. No.: 935,190

[22] Filed: Sep. 22, 1997

Related U.S. Application Data

[63] Continuation of Ser. No. 617,016, Mar. 18, 1996, abandoned, which is a continuation of Ser. No. 77,539, Jun. 17, 1993, abandoned.

[30] Foreign Application Priority Data

Jun. 17, 1992 [JP] Japan ..... 4-158128
Jul. 28, 1992 [JP] Japan ..... 4-222180

[51] Int. Cl.[6] ..... G03G 15/00

[52] U.S. Cl. ..... 399/159; 430/66

[58] Field of Search ..... 430/6.6, 67; 399/159, 399/168, 174, 314, 313

[56] References Cited

U.S. PATENT DOCUMENTS

| | | | |
|---|---|---|---|
| 4,889,782 | 12/1989 | Yamazaki | 355/211 X |
| 4,967,231 | 10/1990 | Hosoya et al. | 355/219 |
| 4,977,430 | 12/1990 | Florack et al. | 355/274 |
| 5,008,172 | 4/1991 | Rokutanzono et al. | 430/66 X |
| 5,034,777 | 7/1991 | Ohzeki et al. | 355/274 |
| 5,055,366 | 10/1991 | Yu et al. | 430/66 X |
| 5,087,543 | 2/1992 | Narita et al. | 430/66 |
| 5,183,719 | 2/1993 | Yagi et al. | 430/66 |
| 5,219,698 | 6/1993 | Suzuki | 355/211 X |

FOREIGN PATENT DOCUMENTS

| | | |
|---|---|---|
| 0057532 | 8/1982 | European Pat. Off. . |
| 0404079 | 12/1990 | European Pat. Off. . |
| 0433055 | 6/1991 | European Pat. Off. . |
| 0443626 | 8/1991 | European Pat. Off. . |
| 57-158664 | 9/1982 | Japan . |
| 61-57958 | 3/1986 | Japan . |
| 61-212849 | 9/1986 | Japan . |
| 63-149669 | 6/1988 | Japan . |

*Primary Examiner*—Robert Beatty
*Attorney, Agent, or Firm*—Fitzpatrick, Cella, Harper & Scinto

[57] ABSTRACT

An electrophotographic apparatus includes a movable photosensitive member having a photoconductive layer, and a charging member for charging the photosensitive member. A latent image forming device forms an image on the photosensitive member, and an electric charge applying device applies an electric charge of a polarity opposite from a charging property of the charging member to the photosensitive member. The photosensitive member includes a rectifying layer on the photoconductive layer to provide, at an interface between the photoconductive layer and the rectifying layer, a p-n junction preventing electric charge of the opposite polarity from entering the photoconductive layer.

17 Claims, 16 Drawing Sheets

ELECTROPHOTOGRAPHY HAVING PHOTOSENSITIVE MEMBER WITH CHARGE BLOCKING OVERLAYER

This application is a continuation of application Ser. No. 08/617,016, filed Mar. 18, 1996, now abandoned, which, in turn, is a continuation of application Ser. No. 08/077,539, filed Jun. 17, 1993, now abandoned.

FIELD OF THE INVENTION AND RELATED ART

The present invention relates to an electrophotographic apparatus such as a copying machine, printer or the like and a process cartridge detachably mountable thereto, more particularly to such an apparatus or process cartridge having a charging member for electrically charging a photosensitive member.

Referring first to FIG. 11, there is shown an example of an image forming apparatus of an electrophotographic type.

Designated by reference numeral 101 is an electrophotographic photosensitive member in the form of a rotatable drum (image bearing member). It comprises an OPC photosensitive layer. The photosensitive member 101 rotates in a clockwise direction indicated by an arrow X at a predetermined peripheral speed (process speed). A charging roller (member) 102 functions to uniformly charge the photosensitive member 101 to a predetermined polarity and potential. The charging roller 102 is supplied with a predetermined charging bias voltage from a voltage source 102A, and the peripheral surface of the rotating photosensitive member 101 is uniformly charged to the predetermined polarity and potential through contact charging process.

In this example, the photosensitive member 101 is of negative polarity OPC photosensitive member, and is charged to the negative polarity by the charging roller 102.

Designated by a reference numeral 103 is image information writing means. For example, it is a laser scanner, slit exposure means (LED array, liquid crystal shutter array or the like). The image information writing means 103 projects exposure beam L representative of the image information on the rotating photosensitive member 101 which has been charged to the negative polarity, so that the electrostatic latent image corresponding to the intended image information is formed on the photosensitive member surface. The surface of the photosensitive member is developed by negatively charged toner by a reverse development device 104 with the toner charged to the negative polarity. The negative charged toner is deposited on the portion of the photosensitive member 101 surface which has been exposed to the light, so that the electrostatic latent image on the photosensitive member is reversedeveloped.

Transfer means 105 is, in this example, a corona transfer device (corona discharger) disposed close to the photosensitive member 101.

A transfer material P is supplied from an unshown sheet feeding station to a transfer position a which is a clearance between the photosensitive member 101 and a corona transfer device 105.

Transfer material P is fed to the transfer position a at such timing that when a leading edge of the toner image on the rotating photosensitive member surface reaches the transfer position a, the leading edge of the transfer material P reaches the transfer position a.

At the time when the leading edge of the transfer material P reaches the transfer position a, the transfer bias is applied to the corona transfer device 105 from the voltage source 105A, so that the corona discharger 105 applies to the backside of the transfer material P electric charge (positive charge, in this example) which is opposite from that of the toner, that is, opposite from the charging polarity of the charging means 102 for the photosensitive member. By doing so, the negative polarity toner image is sequentially transferred from the surface of the photosensitive member 101 onto the surface of the transfer material P.

The transfer material P having received the toner image at the transfer position is separated from the surface of the photosensitive member 101 and is fed to an unshown fixing device, where the transferred toner image is fixed into a permanent fixed image on the transfer material P.

The surface of the photosensitive member 101, after the toner image is transferred onto the transfer material P, is cleaned by a cleaning device 106 so that residual toner or other contaminants are removed, and therefore, is prepared for the next image formation.

Referring to FIG. 12, there is shown an image forming apparatus in which the charging means for the photosensitive member is in the form of a corona discharger 102B, and the transfer means is in the form of a contact type transfer means 105B.

The contact transfer means in this example is in the form of a contactable transfer roller (roller transfer device), and is contacted to the surface of the photosensitive member 101. The transfer material P is fed to the transfer position a where a nip is formed between the photosensitive member 101 and the transfer roller, at a predetermined timed relationship. To the transfer roller 105*b*, the electric charge (positive polarity, in this embodiment) which has the polarity opposite from that of the charging polarity of the transfer member charging means 102*b*, that is, opposite from that of the toner, is applied from the voltage source 105*a*, by which, similarly to the apparatus of FIG. 11, the negative polarity toner image is sequentially transferred from the surface of the photosensitive member 101 onto the fed transfer material P. The contact transfer means 105B may be in the form of a belt or brush or the like.

The contact charging means 102 (FIG. 11) and the contact transfer means 105B (FIG. 12), are advantageous with respect to using a corona discharger, in that a high voltage source is not required, and therefore, the cost is low, in that no wire electrode is used. Accordingly, contamination of the wire does not occur, in that ozone production or NOx production due to the high voltage discharge is small, and therefore, the deterioration of the photosensitive member or the image quality is suppressed.

In the transfer type image forming apparatus in which the reverse-development is carried out, as in FIGS. 11 and 12, the charging polarity of the image bearing member and the transfer polarity are opposite from each other. In the foregoing examples, the charging polarity (primary charging polarity) is negative, and the transfer polarity is positive.

Due to this polarity difference, a problem called "positive memory" occurs.

More particularly, in an image forming apparatus of an image transfer and reverse development type, when the transfer bias (positive polarity, here) is applied directly from the transfer means 105 (FIG. 11) or 105B (FIG. 12) to the surface of the photosensitive member 101 (image bearing member), the positive charge provided by the transfer bias remains on the photosensitive member 101. During the charging of the photosensitive member (negative charge) in the next image forming process, the surface of the photosensitive member is not charged to the predetermined polarity due to the positive charge hysteresis of the photosensitive member due to the transfer bias voltage, and therefore, the charged potential is lower than the proper potential. This is called "positive memory".

The positive memory is more significant if the transfer bias voltage is higher, and it occurs irrespective of the presence or absence of the transfer material P at the transfer position a. The positive memory producing mechanism will be described, referring to FIG. 13. In this Figure, there is shown a layer structure of a photosensitive member 101 of negative charge property. It comprises a base member in the form of an aluminum cylinder 111, a conductive layer 112 thereon, an injection preventing layer 113 thereon for preventing dark delay due to positive holes from the aluminum base member 111, a charge generating layer 114 and p-type charge transfer layer 115 of semiconductor material.

FIG. 13 shows the transfer position a when the sheet is absent at the transfer position a, such as during the pre-rotation of the photosensitive member or during sheet intervals. The surface of the photosensitive member moves in a direction indicated by an arrow X. In this Figure, the transfer means is in the form of a corona charger 105.

Negative charge −e on the photosensitive member 101 comes to the corona transfer device 105 (transfer means) with rotation of the photosensitive member 101. A transfer bias is applied from a voltage source 105A to the corona transfer device 105, so that the positive charge +e is generated, and therefore, it neutralizes the negative charge −e on the photosensitive member 10.

If the applied transfer bias voltage is high, an excessive amount of positive charge +e is produced, and it enters the charge transfer layer 115 of the p-type semiconductor, and it is trapped, as indicated by +e'.

Even if the photosensitive member 101 is charged to the negative polarity by charging means 102 or 102*b* during the next image formation process, the positive charge +e' trapped in the charge transfer layer 115 is not easily moved to the surface of the layer 115, and it neutralizes the negative charge −e on the surface of the layer 115 after passing by the charging means 102 or 102*b*, and therefore, the surface potential of the photosensitive member 101 is not as high as desired.

In this manner of the image transfer and reverse development type, the positive memory occurs in the image forming apparatus. of the image transfer and reverse development type.

The positive memory appears as a improper resultant image as scattering of toner and/or image density non-uniformity. The positive memory tends to occur in the portion of the photosensitive member corresponding to the leading edge of the transfer material P. In this case, it results in an improper image such as black stripes or the like.

Therefore, some measures have been taken to solve this problem. For example, in the sheet absent period, the transfer bias voltage applied to the corona transfer device 105 is lowered, or the transfer bias voltage is made in the form of pulses. As another measure, the transfer bias voltage is applied when the leading edge of the transfer material enters the transfer position a to a certain degree, and the transfer bias is lowered before the trailing edge of the transfer material leaves the transfer position a. The control system therefor is complicated, with the result of cost increase due to the control system for the transfer means 105.

When the transfer means is a contact transfer means 105*b*, the contact transfer member in the form of a transfer roller 105*b* is in contact with the surface of the photosensitive member 101, and therefore, the positive memory easily occurs, with the result that the toner scattering, image non-uniformity or the like due to the positive memory due to the corona transfer device 105 is further worsened.

Furthermore, the positive memory during the sheet absent period such as during the pre-rotation of the photosensitive member or during the sheet interval, is increased, thus lowering the photosensitive member charge potential with the result of production of the foggy background.

For this reason, in the contact transfer method, in order to prevent application of a large amount of positive charge to the photosensitive member 101, the material of the transfer roller 105*b* is desirably a semiconductor material in consideration of the three parameters which will be described hereinafter.

More particularly, in order to provide the transfer roller 105*b* which does not result in the improper image due to the positive memory and which can provide proper transfer property, the resistance of the transfer roller 105*b* is one of important factors. The conditions influential to the resistance of the transfer roller, are:

(1) Maximum voltage (Vmax) output.

(2) Minimum transfer current (Imin) to prevent improper transfer under low temperature and low humidity condition (N/L).

(3) Upper limit of the transfer current (Imax) for preventing occurrence of positive memory.

The maximum output voltage (Vmax) is determined by the design specification of the image forming apparatus itself. Generally, from the standpoint of cost and safety, it is generally 3–5 KV.

The minimum transfer current (Imin) is determined in consideration of the increase of the resistance of the transfer material P and the transfer roller 105B under the N/L condition.

More particularly, under the N/L condition, the resistance of the transfer material P and the transfer roller 105B increase, and therefore, the transfer current decreases. As a result, it becomes not possible to supply the electric charge required for attracting the toner image onto the transfer material P, to the backside of the transfer material, with the result of improper image transfer or the like. In order to prevent this, the minimum transfer current (Imin) is required. When the transfer voltage Vmax is limited, the limit of the resistance of the transfer roller is required in order to assure the minimum transfer current Imin.

The existence of the upper limit (Imax) of the transfer current is one of most important problems in using the transfer roller 105. That is, as described hereinbefore, the positive memory occurs when the amount of electric charge applied to the photosensitive member 101 from the transfer roller 105B in the sheet absent period, is too large. In the primary charging operation for the photosensitive member after the next image formation process (after the previous transfer operation), the surface potential of the photosensitive member is not charged to the predetermined potential, with the result of a foggy background in the next image output. Therefore, the upper limit (Imax) of the transfer current exists to prevent the foggy background image formation.

In order to meet the Imin requirement, it is required that the Vmax is increased, or the resistance of the transfer roller 105*b* is decreased. However, in order to meet the Imax requirement, the opposite situation occurs from that for meeting the Imin requirement. In other words, it is required that the Vmax is decreased, or the resistance of the transfer roller 105B increased. If the Vmax is constant, the usable range of the resistance of the transfer roller 105B is necessarily determined by the Imin and Imax requirements.

The current Imin is determined from the standpoint of transfer performance. On the other hand, the current Imax is determined from the standpoint of the positive memory of the photosensitive member 101 used therewith. Therefore, the current Imin is determined through theoretical process to a certain degree, and the electric charge amount per unit area is substantially constant, irrespective of the image forming apparatus, but the current Imax is different depending on individual photosensitive members. For this reason, the current Imax changes with use of the photosensitive member.

Referring to FIG. 14, there is shown by hatching lines a usable range of the resistance of the transfer roller 105B on the basis of the conditions (1), (2) and (3), with the following conditions:

Process speed: 23 mm/sec

Maximum usable size: A4

Vmax: 3.5 KV In this example,

Imin=0.5 $\mu$A

Imax=2 $\mu$A have been emprically confirmed. Here, Imin and Imax are total currents flowing through the transfer roller.

If the resistance of the transfer roller 105B is not in this range, the disturbance to the image as described hereinbefore will occur.

When a constant voltage control is carried out with Vmax of 2 KV, the usable range of the resistance of the transfer roller 105B is $4\times10^8$–$2.5\times10^9$ ohm and, when Vmax=3 KV $5\times10^8$–$4\times10^9$ ohm. Thus, the usable range is as small as a 0.79–0.9 order.

On the other hand, the resistance of the transfer roller 105B varies by 1 order or more depending on the ambient conditions, and therefore, the image transfer performance is not stabilized.

It would be considered to control the transfer roller so as to flow constant current in the range of 0.5–2.0 $\mu$A, but in the case of a contact type transfer method, the transfer current undesirably flows into the region where the transfer roller and the photosensitive member are contacted to each other when the size of the used sheet is small, with the result of improper image transfer, and therefore, it is difficult to use the constant current control in the normal situation.

As described in the foregoing, in an image transfer and reverse development type image forming apparatus, a very complicated transfer control system is required because of the occurrence of the positive memory of the photosensitive member due to the transfer operation. This results in a cost increase. When the transfer means is of contact transfer type, the positive memory occurs more strongly, and therefore, it is difficult to use it. In the foregoing conventional examples, the charging polarity of the photosensitive member is negative, and the transfer charge polarity is positive. The same photosensitive member memory occurs even in the opposite case, that is, the charging polarity of the photosensitive member is positive, and the charging polarity of the transfer device is negative.

The description will be made as to the case in which the photosensitive member 101 is charged by a charging roller 102 contacted thereto, as shown in FIG. 11. The charging of the member to be charged is effected by the electric discharge from the charging member to the member to be charged, and therefore, the charging action starts upon application of a voltage not less than a threshold value. For example, when a charging roller is press-contacted to an OPC photosensitive member having a thickness of 25 microns, the surface potential of the photosensitive member starts to increase if the voltage is not less than approx. 640 V, and thereafter, the surface potential of the photosensitive member linearly increases with an inclination of 1 relative to the applied voltage. Hereinafter, the voltage is defined as a charge starting voltage Vth.

Thus, in order to provide the surface potential Vd required for the electrophotography, the charging roller has to be supplied with Vd+Vth, which is not less than the required potential Vd. Hereinafter, the charging by application of only DC voltage to the contact charging member, is called DC charging.

However, in the case of the DC charging, the resistance of the contact charging member changes due to the ambient condition change, and the threshold Vth varies depending on the thickness change (due to scraping) of the photosensitive member, and therefore, it has been difficult to provide a desired potential in the photosensitive member.

In order to provide uniform charging, Japanese Laid-Open Patent Application No. 149669/1988 discloses a charging system (AC charging) in which the contact charging member is supplied with an AC voltage having a peak-to-peak voltage not less than 2×Vth, biased with a DC voltage corresponding to the intended potential Vd. This is intended to use a uniforming effect of the AC voltage. The potential of the member to be charged converges to the potential Vd which is the center of the AC voltage. The system is advantageous in that it is not easily disturbed by an ambient condition change or the like.

However, such a contact charging device uses the electric discharge from the charging member to the photosensitive member, and therefore, the voltage required for the charging is higher than the potential to which the surface of the photosensitive member is to be charged. A small amount of ozone is produced. When an AC charging is carried out for the purpose of uniform charging, other problems such as a larger amount of ozone production, vibration and noise due to the mechanical vibration of the photosensitive member and the charging member due to the application of the AC electric field (AC charging noise), deterioration of the surface of the photosensitive member attributable to the discharging, arise.

As disclose in Japanese Laid-Open Patent Application No. 57958/1986, it is known that the photosensitive member is charged by electrically conductive particles contacted thereto. However, the ratio of the potential to which the photosensitive member is charged relative to the voltage applied to the charging member is low, that is, the charging efficiency is low.

SUMMARY OF THE INVENTION

Accordingly, it is a principal object of the present invention to provide an electrophotographic apparatus and method in which the toner scattering, image density non-uniformity, foggy background or another image defect, are prevented.

It is another object of the present invention to provide an electrophotographic apparatus and method in which a charge memory in the photosensitive member is prevented.

It is a further object of the present invention to provide an electrophotographic apparatus in which the cost for controlling the transfer operation is decreased, and therefore, the cost of the apparatus is decreased.

It is a further object of the present invention to provide an electrophotographic apparatus and method and a process cartridge in which the deterioration of the surface of the photosensitive member is significantly decreased.

It is a further object of the present invention to provide an electrophotographic apparatus and method and a process cartridge in which the charging efficiency of the photosensitive member is increased.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
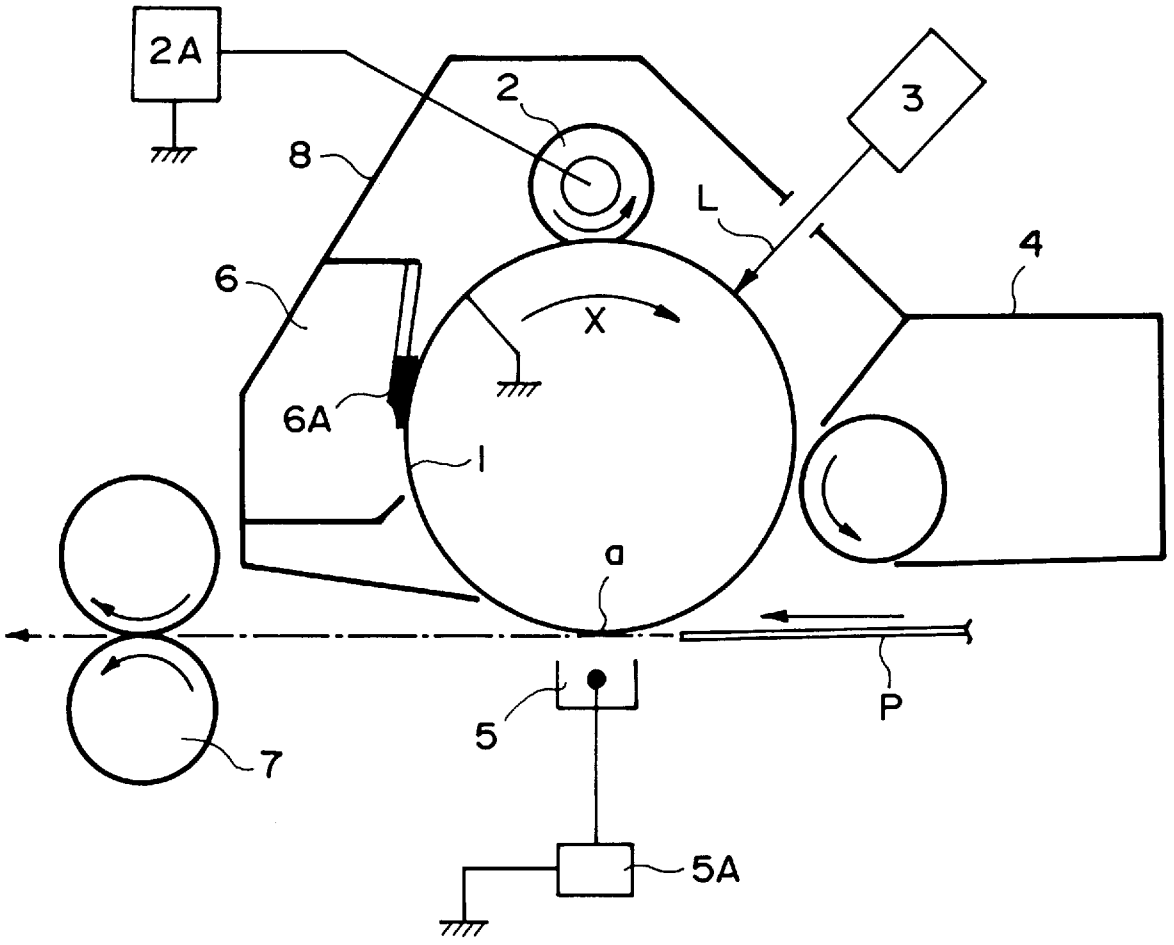
FIG. 1 is a sectional view of an image forming apparatus according to a first embodiment of the present invention.

Referring to FIG. 1, there is shown an example of an image forming apparatus according to an embodiment of the present invention. The image forming apparatus comprises a rotatable drum type electrophotographic photosensitive member (image bearing member) 1, a contact charging roller (charging means) 2, a charge bias voltage source 2A, an information writing means 3, a reverse development device 4, a corona transfer device 5, a voltage source 5A for the transfer bias voltage, and a cleaning device 6. It further comprises a heating roller type image fixing device 7. Designated by a reference numeral 8 is a process cartridge, and in this embodiment, it contains as a unit the photosensitive member 1, the contact charging roller 2, the reverse development device 4 and the cleaning device 6. The process cartridge is detachably mountable to the image forming apparatus as a unit.

In this embodiment, the photosensitive member 1 rotates in a clockwise direction indicated by an arrow X at a predetermined peripheral speed (process speed). The photosensitive member is a negatively chargeable OPC photosensitive member, having a rectifying layer on a photosensitive layer, which will be described hereinafter. The photosensitive member 1 is electrically charged by the contact charging roller 2. In this embodiment, the photosensitive member 1 is a negatively chargeable OPC photosensitive member, and it is charged by the charging roller 2 to the negative polarity.

By a laser scanner, a slit exposure means, LED array, liquid crystal shutter array or the like (image information writing means 3), intended image information exposure light L is projected onto a rotating photosensitive member 1 surface which has been charged to the negative polarity, by which an electrostatic latent image is formed on the surface of the photosensitive member 1 in accordance with the intended image information.

Subsequently, the surface of the photosensitive member is developed with the negatively charged toner by the reverse development device 4. By the deposition of the negative toner particles on the portion which has been exposed to the light, by which the electrostatic latent image is reverse-developed on the surface of the photosensitive member 1.

A transfer material P is supplied to a transfer position a such that when a leading edge of the toner image formed and carried on the rotating photosensitive member surface, the leading edge of the transfer material P reaches the transfer position a.

At the time when the leading edge of the transfer material P reaches the transfer position a, the transfer bias voltage is applied to the corona transfer device 5 from the voltage source 5A, so that the electric charge (positive charge, in this embodiment) which has the polarity opposite from that of the toner, that is, opposite from the charging polarity of the primary charging means 2 for the photosensitive member, is applied to the backside of the supplied transfer material P, by which the negative polarity toner image is continuously transferred from the surface of the photosensitive member 1 onto the surface of the transfer material P.

The transfer material P now having the toner image through the transfer position a, is separated from the surface of the photosensitive member 1, and is introduced into an unshown image fixing device, where the transferred toner image is fixed on the transfer material P as a permanent fixed image.

The surface of the photosensitive member 1, after the toner image transfer onto the transfer material P, is cleaned by a cleaning device 6 so that the contaminations such as residual transfer toner or the like is removed. Then, the photosensitive member is repeatedly usable for the image formation. The reverse development device 4 is a jumping developing device using a one component magnetic toner.

The cleaning device 6 includes a counter blade 6*a* of urethane rubber material which is effective to clean the surface of the photosensitive member.

Figure 2:
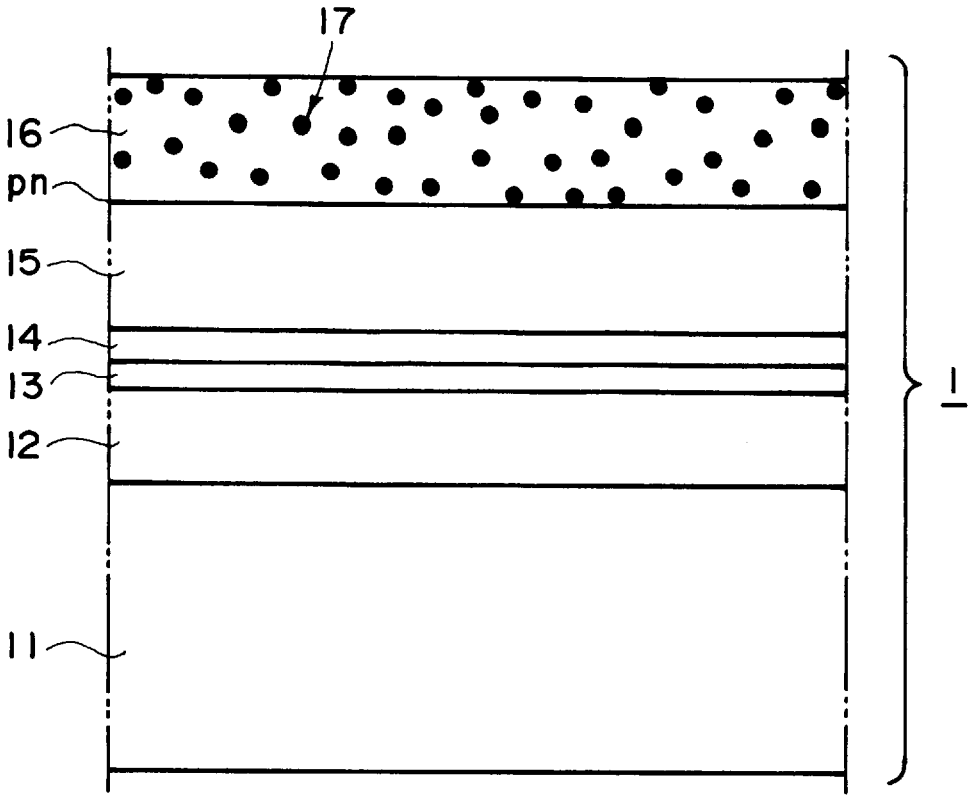
FIG. 2 is a sectional view illustrating a layer structure of an image bearing member.

FIG. 2 shows a layer structure of the photosensitive member 1. In this embodiment, it includes a function-divided OPC photosensitive member, and a rectifying layer is provided thereon.

On an aluminum cylinder (aluminum base) 11 having a diameter of 30 mm and electrically grounded, a conductive layer 12 (CP layer) having a thickness of approx. 20 microns is formed as a lower layer.

In order to prevent dark decay attributable to injection of positive holes from the aluminum base 11, an injection preventing layer 13 (UC layer) is formed. The layer 13 is of electrically intermediate resistance material. In this embodiment, an insulative aluminum resin and methoxymethyl nylon exhibiting a certain degree of ion conductivity, and the mixture is painted into approx. 1 micron.

On the UC layer 13, a charge generating layer (CG layer) 14 is formed. Polyvinylbutylal resin binder and diazo pigment (charge generating material) are mixed at 1:2, and the mixture is painted into approx. 1 micron thickness.

A p-type semiconductor charge transfer layer 15 (CT layer) is formed on the CG layer 14. Among charge couples generated in the charge generating layer 14, the CT layer 15 functions to transfer only the positive charge to the surface of the photosensitive member. Specifically, polycarbonate resin and hydrazone are mixed at 1:1 weight ratio, and the mixture is painted into a layer thickness of 20 microns.

The rectifying layer 16 comprises phosphazene resin and electrically conductive filler material 17 which is $SnO_2$ doped with small amount of Sb (the weight of conductive filler material/the total weight of the conductive filler and the resin binder ×100 =30% by weight) the rectifying layer 16 has a film thickness of approx. 10 microns.

Figure 3:
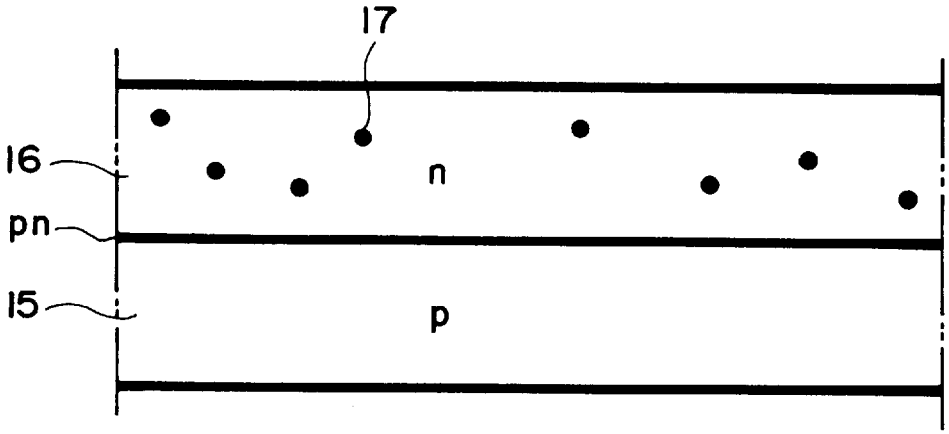
FIG. 3 is a sectional view illustrating a rectifying function.

Referring to FIG. 3, the description will be made as to the rectifying function. In this embodiment, the $SnO_2$ doped with a small amount of Sb dispersed as the conductive filler 17 in the rectifying layer 16 is a semiconductor oxide, and the conductive type is n-type. The CT layer 15 below the rectifying layer 16 exhibits p-type electric conductivity. Thus, at the interface between the CT layer 15 and the rectifying layer 16, a p-n junction is established.

With this structure, the positive charge is capable of moving from the CT layer 15 (p-type) to the rectifying layer 16 (n-type). However, the opposite movement, that is, the movement from the rectifying layer 16 to the CT layer 15 is not permitted because of Schott key barrier of the energy level. By this, the occurrence of the positive memory due to the transfer is prevented.

Figure 4:
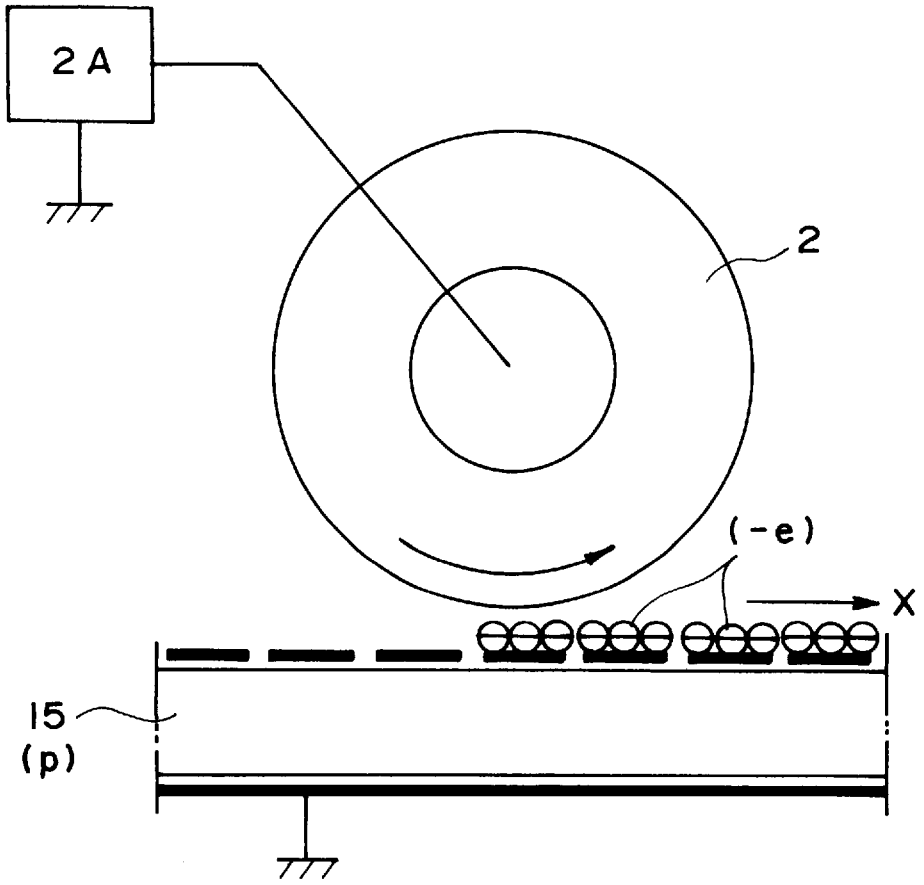
FIG. 4 is a sectional view illustrating a charging action.

In the charging portion, the rectifying layer 16 functions as if it is a charge injection layer. The $SnO_2$ particles of the conductive filler 17 exposed at the surface function as a capacitor electrode. That is, if the dispersion amount of the conductive filler 17 is appropriate, it is considered that a great amount of capacitors sandwiching the CT layer 15 are disposed as dielectric material on the surface of the photosensitive member as shown in FIG. 4, without the possibility of disturbance of "flow" of the image.

Since the CT layer 15 is of p-type semiconductor, since the negative charge does not move through the CT layer, and since there is no supply of positive charge from the CG layer 14 below the CT layer 15, then it is not possible to neutralize the electric charges by re-combination.

By contacting an electrically conductive charging member 2 to the electrode, and by applying the voltage thereto, the electric charge can be injected into the electrode in the similar manner as in a normal capacitor.

When the surface reaches the exposure station, it is exposed to light, so that couples of positive and negative charges are generated in the charge generating layer 14. The negative charge passes through the UC layer 13 and CT layer 12, and combined in the aluminum cylinder 11. The positive layer moves through the CT layer 15. As shown in FIG. 3, the CT layer 15 and the rectifying layer 16 are connected by p-n junction, and therefore, the positive charge flows into the rectifying layer 16, and neutralizes, thus providing an exposed portion potential. In the portion of the photosensitive member which is not exposed to the light, the negative charge is retained in the rectifying layer 16, and therefore, the charged potential remains.

In the developing position, the toner is deposited on the OPC photosensitive member having the rectifying layer 16 to develop the image, but the electric charge in the photosensitive member 1 does not change.

Figure 5:
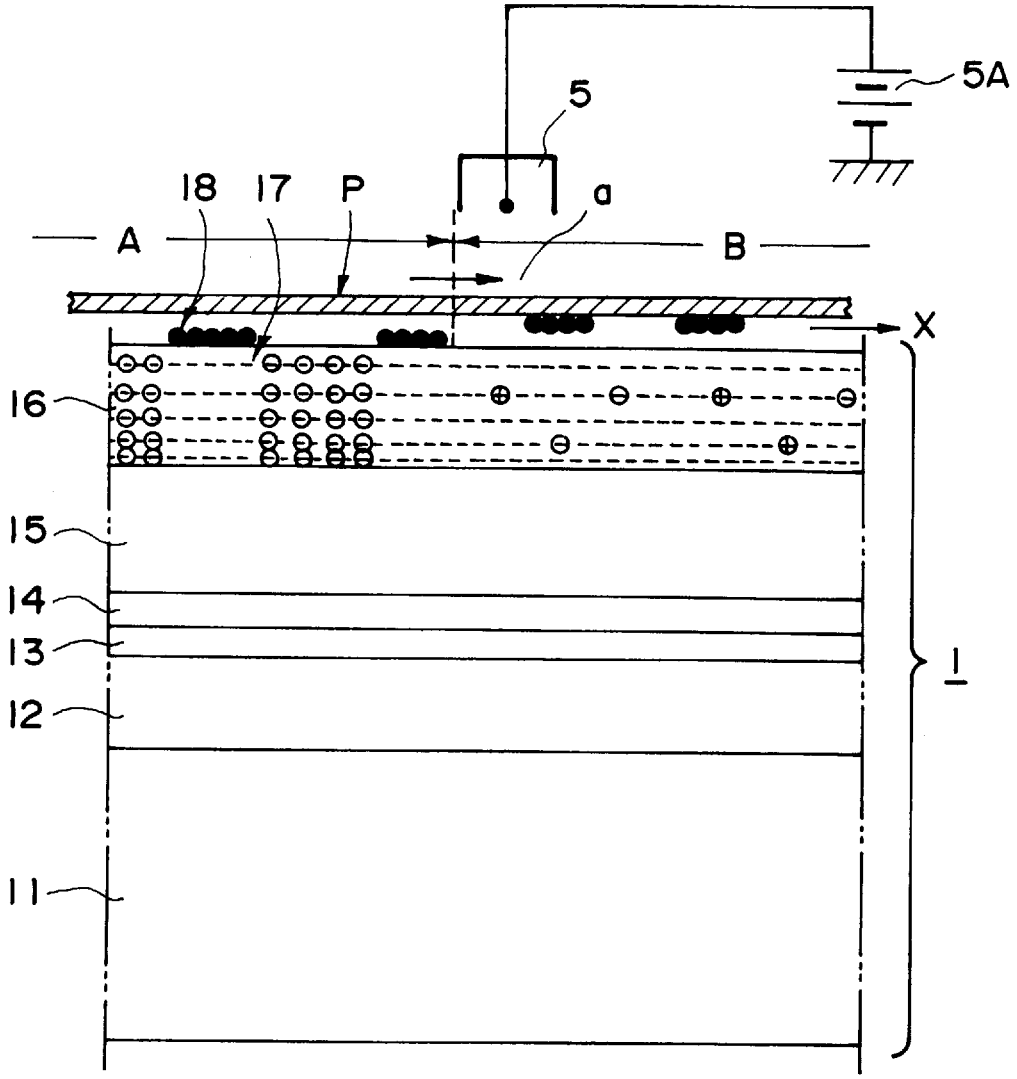
FIG. 5 is a sectional view illustrating a rectifying function in an image transfer position.
Figure 6:
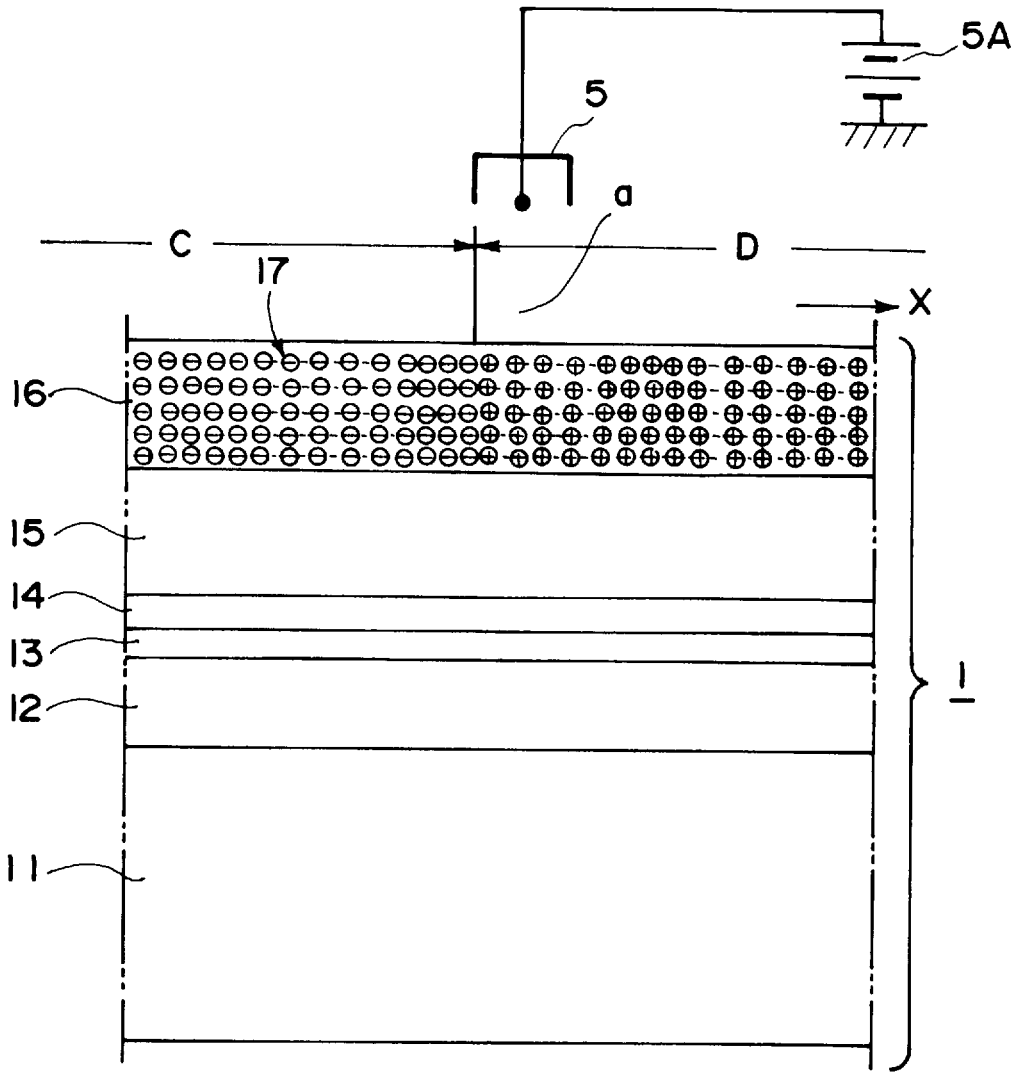
FIG. 6 is a sectional view illustrating a rectifying function at the image transfer position.

FIG. 5 shows the electric charges in the OPC photosensitive member 1 in the transfer material P passage region. FIG. 6 shows the electric charges of the OPC photosensitive member 1 in the transfer material absent region.

In FIG. 5, the surface of the photosensitive member 1 is moving in a direction X. In a region A immediately before the corona transfer charger 5 in the transfer position a, the transfer material P is close to the surface. As for the electric charge distribution in the rectifying layer 16, there is no electric charge or there is only a small amount of electric charge in the conductive filler 17 of the rectifying layer 16 in the region of the photosensitive member surface where the negative toner 18 is deposited (exposure potential). On the other hand, in the region where the toner 18 is not deposited, a great number of negative charge results due to the charged potential.

It is considered that in the region B after the corona transfer device 5, the toner 18 is transferred from the OPC photosensitive member 1 onto the transfer material P in the manner similar to the conventional example, and the negative charge of the rectifying layer 16 is neutralized by the positive charge provided by the corona discharge.

In the sheet absent case as in the sheet non-passage area where the surface of the photosensitive member is directly faced to the corona transfer charger 5 during transfer action (when a small size sheet is used), during the pre-rotation period of the photosensitive member, or the sheet absent period between adjacent sheets, the conductive filler 17 in the rectifying layer 16 has the negative charge in the region C immediately before the corona transfer charger 5 in the transfer position a, as shown in FIG. 6, because it has not been exposed to the light.

In the region D after the corona charger 5, the transfer bias voltage is directly, that is, without transfer material, applied to the OPC photosensitive member 1, and therefore, a transfer current larger than that in the region B in FIG. 5 flows in the OPC photosensitive member 1. As shown in FIG. 6, in the region D, a large amount of positive charge is present in the rectifying layer 16.

In the conventional structure, the positive charge enters deep into the CT layer 15 in the region D, and the positive charge is trapped. In the next primary charging to the negative polarity, the positive charge is not capable of immediately moving to re-combine with the negative charge, and therefore, the potential is not high enough because of the positive memory.

In this embodiment, however, the rectifying layer 16 of the photosensitive member is effective to provide a barrier against the charge movement in the direction opposite from the charge polarity of the photosensitive member by a combination of the CT layer 15 and the rectifying layer 16, so that the positive charge of the rectifying layer 16 is prevented from entering the CT layer 15.

By doing so, the charge is present only in the rectifying layer 16, and therefore, the positive charge easily moves during the next charging operation, and the charges re-combine with the negative charges, thus permitting reduction of the potential of the rectifying layer 16 down to any negative potential.

Figure 13:
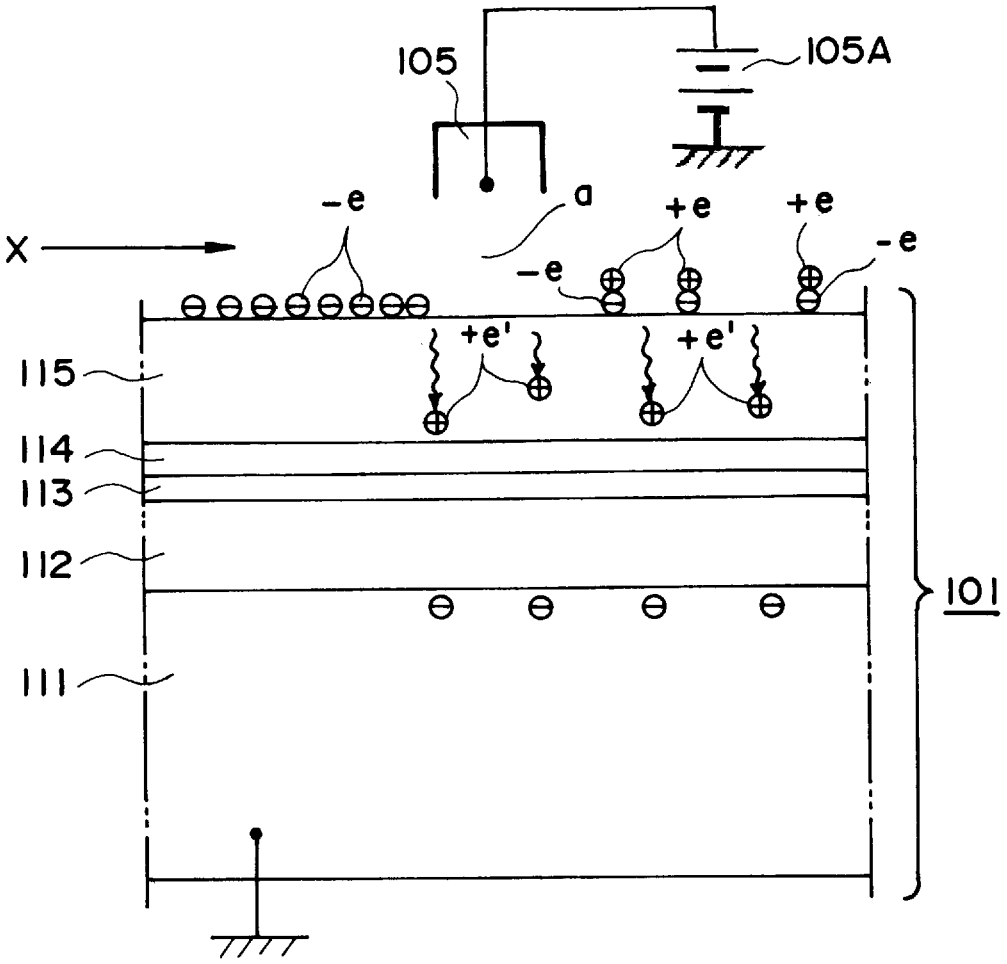
FIG. 13 schematically illustrates "positive memory" phenomenon.

In experiments by the inventors, the surface potential, after the image transfer operation of the sheet absent region of the photosensitive member was higher than that in the conventional device (positive polarity). The reason is considered as follows. Since in the conventional example the positive charge enters deep into the CT layer 15 (FIG. 13), the apparent surface potential is low, but in this embodiment, the positive charge is present in the rectifying layer 16, and therefore, the surface potential is high.

In the manner described above, the occurrence of the positive memory can be prevented according to this embodiment.

In the conventional device, when the transfer means is a corona transfer device 5, the transfer voltage is on-off-controlled for the sheet absent period as between adjacent sheets to reduce the transfer current for the purpose of preventing the positive memory. According to this embodiment, however, by the provision of the rectifying layer 16 having dispersed fine metal particles on the OPC photosensitive member, the transfer current into the OPC photosensitive member is increased, and therefore, even if the current flowing into the photosensitive member (drum) is increased, no positive memory is produced. For this reason, the on-off control of the transfer bias for the sheet absent period is not required, and the simple structure is enough to avoid the improper image formation which has been a problem in the conventional device, such as scattering of the toner, density non-uniformity, the disturbance of the image at the leading and trailing edges of the transfer material P, or the like.

In this embodiment, the negatively chargeable OPC photosensitive member is used with the positive polarity transfer bias, but the same advantageous effects can be provided even when the positively chargeable OPC photosensitive member is used with a negative polarity transfer bias, if the photosensitive member as a layer having a rectifying function. The photosensitive member is not limited to an OPC photosensitive member.

In this embodiment, the fine metal particles of $SnO_2$ doped with Sb is dispersed in the rectifying layer 16, but another metal oxide or conductive carbon or the like having n-type or p-type semiconductive property.

Other usable examples of metal oxide include, in addition to $SnO_2$, $TiO_2$, $ZnO_2$, $In_2O_3$, $Cu_2O$, $Wo_3$, $BaTiO_2$, doped with a chemical impurity. The metal particles may have a large work function.

The binder of the rectifying layer 16 is of phosphazene resin material in this embodiment. However, this is not limiting, and other materials are usable if the transparency is high, and the fine metal particles can be dispersed well, and the resistance is adjustable.

Embodiment 2

Figure 7:
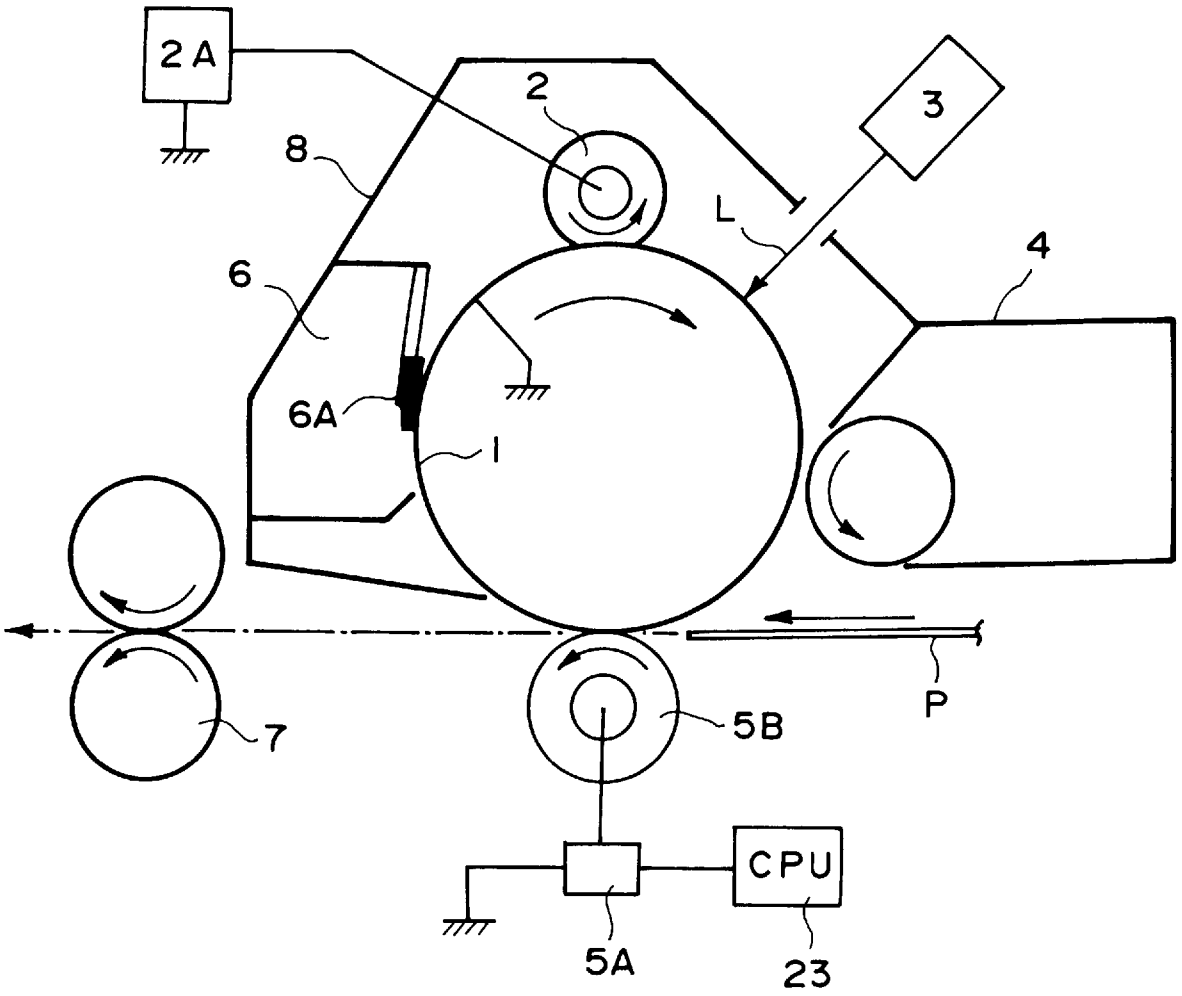
FIG. 7 is a sectional view of an image forming apparatus according to a second embodiment of the present invention.

This embodiment is a modification of the image transfer and reverse development type image forming apparatus of the first embodiment (FIG. 1). More particularly, in place of the corona transfer device 5, a contact transfer roller 5B is used, as shown in FIG. 7.

The rectifying layer 16 of the OPC photosensitive member 1 comprises the phosphazene resin material and conductive filler material (70% by weight=weight of the conductive filler material/total weight of the conductive filler material and the binder resin) dispersed in the resin material, the conductive filler 17 comprising $SnO_2$ doped with Sb.

The image forming apparatus of this embodiment is the same as that of the first embodiment in the other respects, and therefore, the detailed description thereof are omitted for simplicity.

In this embodiment, the resistance of the transfer roller 5B was $6\times10^6$ ohm, and the transfer bias voltage was constant-voltage-controlled, and 1 KV is applied to the transfer roller 5B from a constant voltage bias source 5A, under the control of CPU 23.

According to this embodiment, such a rectifying layer 16 is provided on the OPC photosensitive member, and the transfer means is in the form of a transfer roller 5B, by which the latitude of the volume resistivity of the transfer roller 5B is expanded.

As described hereinbefore in conjunction with conventional examples, the transfer roller is advantageous in that the amount of ozone production is small, and that the image deterioration is not significant, or the like.

However, the production of a foggy background and the stabilized mass-production are problems because of the positive memory. In addition, the resistance of the transfer roller is $5\times10^8$–$5\times10^9$ ohm.

As has been described in conjunction with the first embodiment, the photosensitive member having the rectifying layer 16 provides a larger tolerance relative to the positive memory due to the current into the photosensitive member than the conventional photosensitive member.

Figure 8:
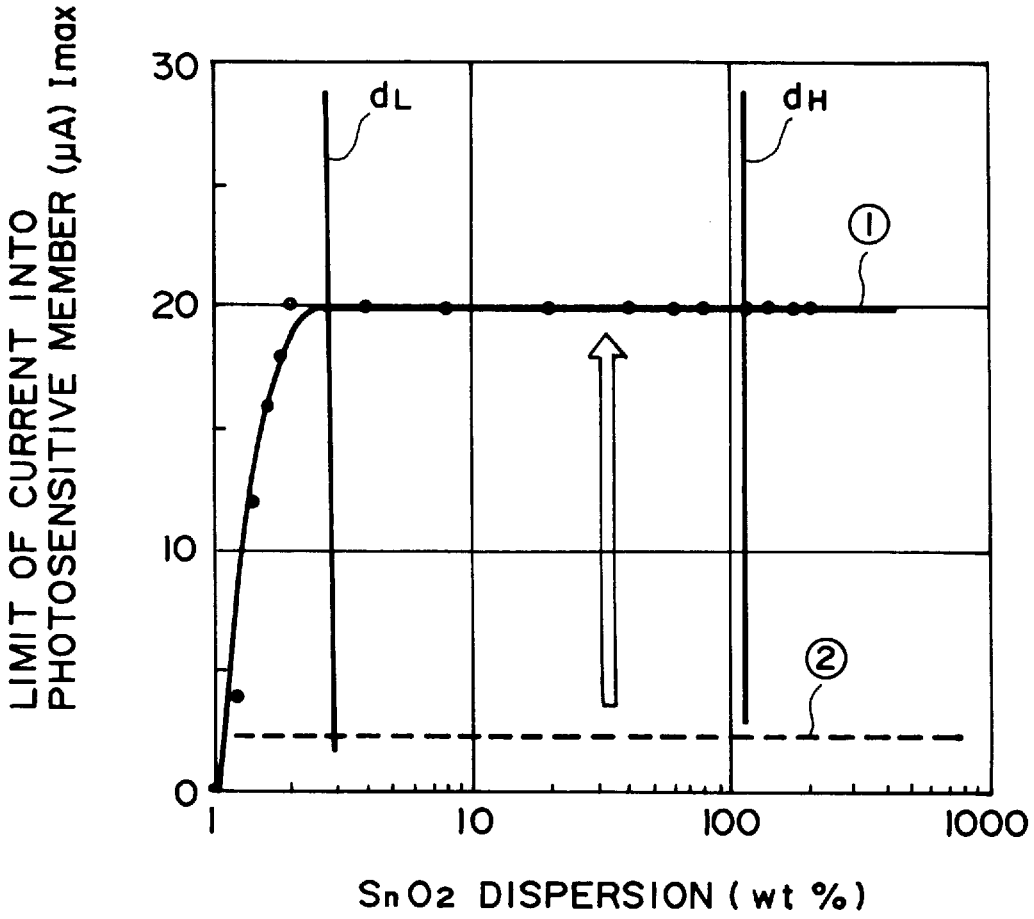
FIG. 8 is a graph showing a relationship between an amount of $SnO_2$ dispersion in a rectifying layer and a limit of a current flowing into the photosensitive member.

FIG. 8 shows the maximum current (Imax) into the photosensitive member with which the positive memory does not occur, relative to the amount of dispersion of $SnO_2$ doped with Sb.

Line (1) represents the case of the photosensitive member of this embodiment, in which the maximum current Imax is 20 $\mu$A.

The minimum dispersion is indicated by $d_L$. If the dispersion is lower than this, improper charging occurs. The maximum amount of dispersion is indicated by $d_H$, and if it is larger than this maximum limit, "flow" of the image occurs.

Broken line (2) represents the maximum current Imax in the conventional photosensitive member, and it is approx. 20 $\mu$A. As will be understood, the tolerance is larger with the case of (1), against the current flowing into the photosensitive member.

Figure 9:
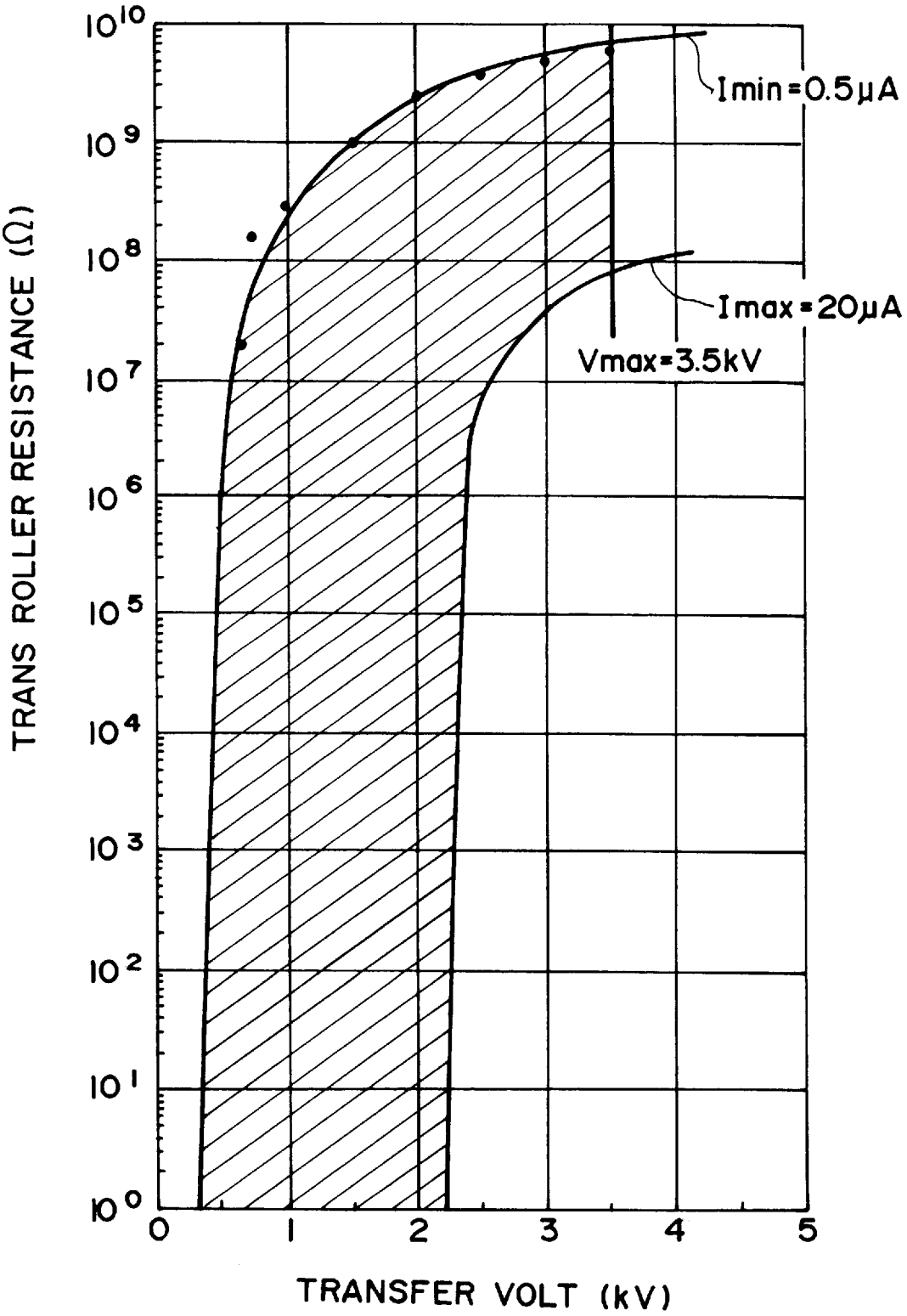
FIG. 9 is a graph showing resistance latitude of a transfer roller.
Figure 14:
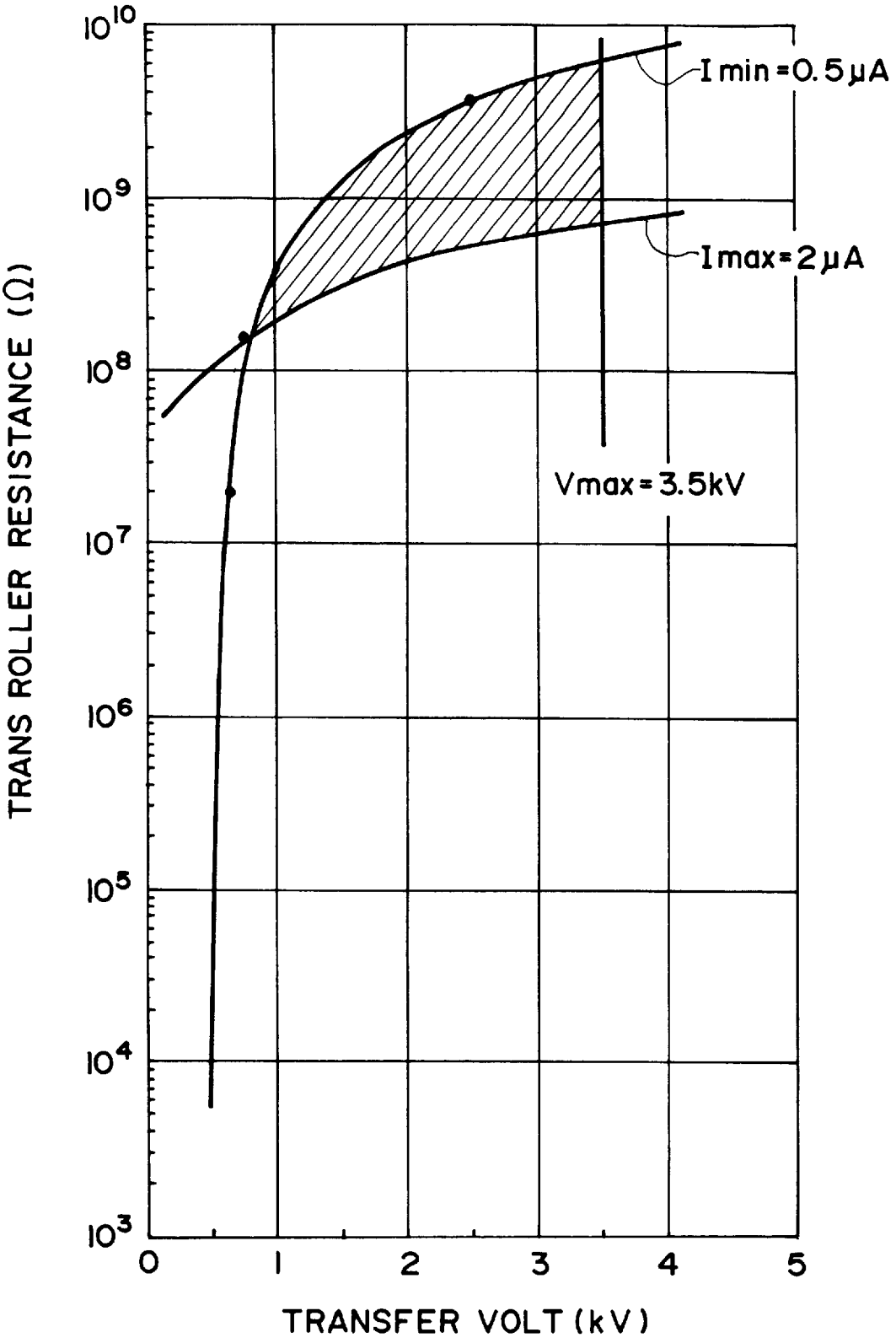
FIG. 14 is a graph showing a resistance latitude of a transfer roller.
Figure 15:
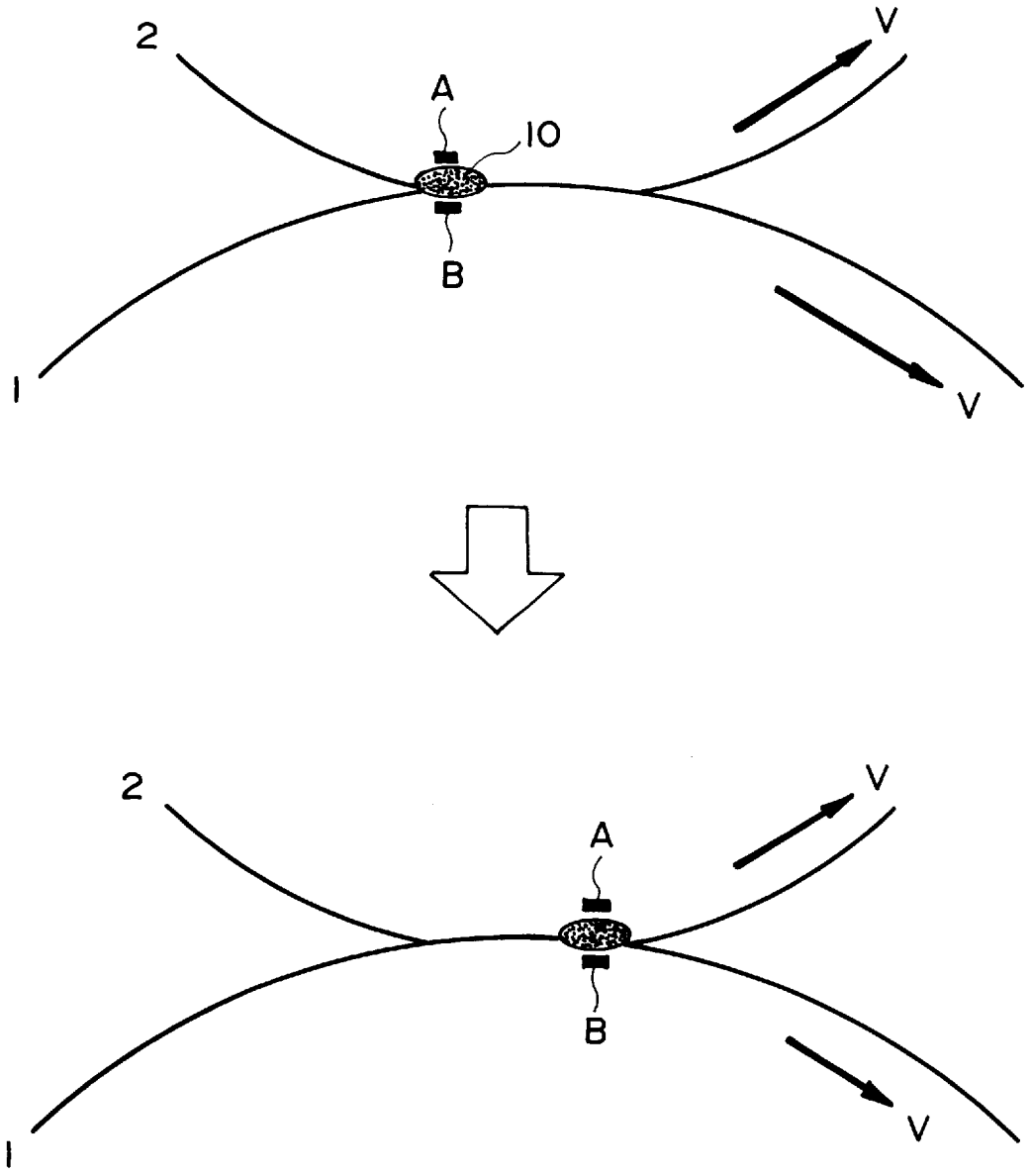
FIGS. 15 and 16 are sectional views illustrating foreign matter existing in a charging region.

FIG. 9 shows a latitude of the resistance of the transfer roller when the photosensitive member of this embodiment is used. Conventionally, it is narrow, as shown in FIG. 14.

According to this embodiment, the proper resistance of the transfer roller is as low as it can be, and still be called an electrically conductive roller. For example, heretofore, the proper low resistance of the transfer roller at the applied transfer voltage of 1.5 KV, was $5\times10^8$–$5\times10^9$ ohm.

According to this embodiment, the usable resistance extends from conductive roller to $5\times10^9$ ohm.

Therefore, the latitude of the usable resistance is remarkably increased.

By the remarkable expansion of the latitude of the resistance of the transfer roller, the proper transfer is possible without positive memory even if the roller resistance varies due to the ambient condition variation.

The low resistance of the roller is usable. This is advantageous because the conventional mass-production is difficult because of the intermediate resistance of the roller material. The usability of the low resistance material for the transfer roller permits stabilized production with low cost and high yield.

The transfer roller is usable only with constant voltage control over a wide range from high temperature and high humidity condition to the low temperature and low humidity condition.

Embodiment 3

This is a modification of the second embodiment (FIG. 7) in that the contact transfer roller 5B is constant-current-controlled. In this embodiment, the voltage source 5A is a constant current voltage source.

The photosensitive member comprises the rectifying layer 16 on the OPC photosensitive layer. The rectifying layer comprises phosphazene resin (binder resin) and 10% by weight of conductive filler (weight of the conductive filler/total weight of the conductive filler and binder). The conductive filler comprises $SnO_2$ doped with Sb. By reducing the amount of dispersion, the resistance of the rectifying layer is increased to control the electric current flowing into the photosensitive member in the sheet absent region of the photosensitive member. The resistance of the transfer roller 5 was $6\times10^6$ ohm.

As described in the second embodiment, the photosensitive member having the rectifying layer 16 provides a wider tolerance against positive memory as compared with the conventional photosensitive member, against the current flowing into the photosensitive member.

Figure 10:
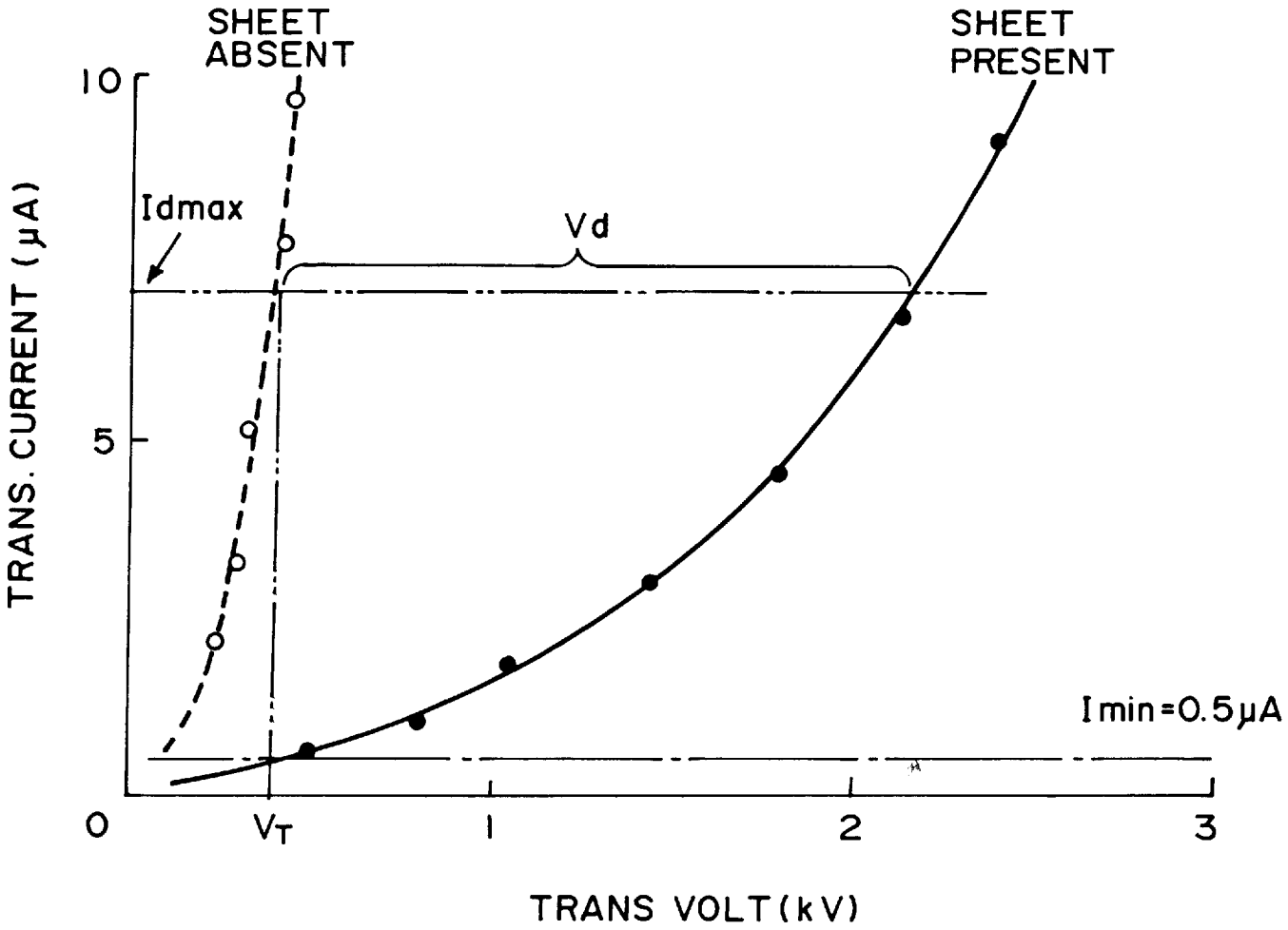
FIG. 10 is a graph showing a relationship between an applied transfer voltage and a transfer current in an image forming apparatus according to a third embodiment of the present invention.
Figure 11:
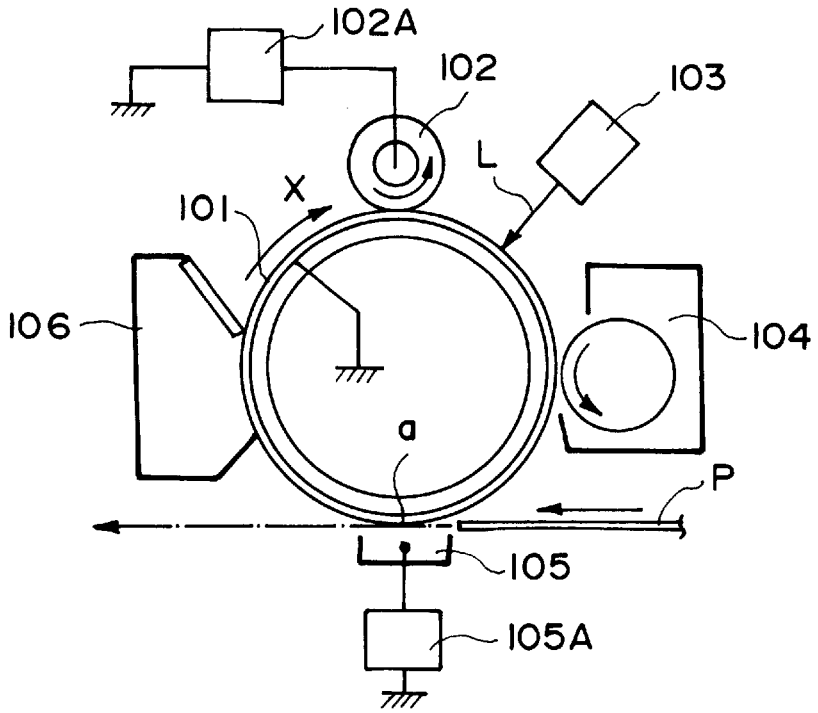
FIG. 11 is a sectional view of an image transfer and reverse development type image forming apparatus of a conventional example.
Figure 12:
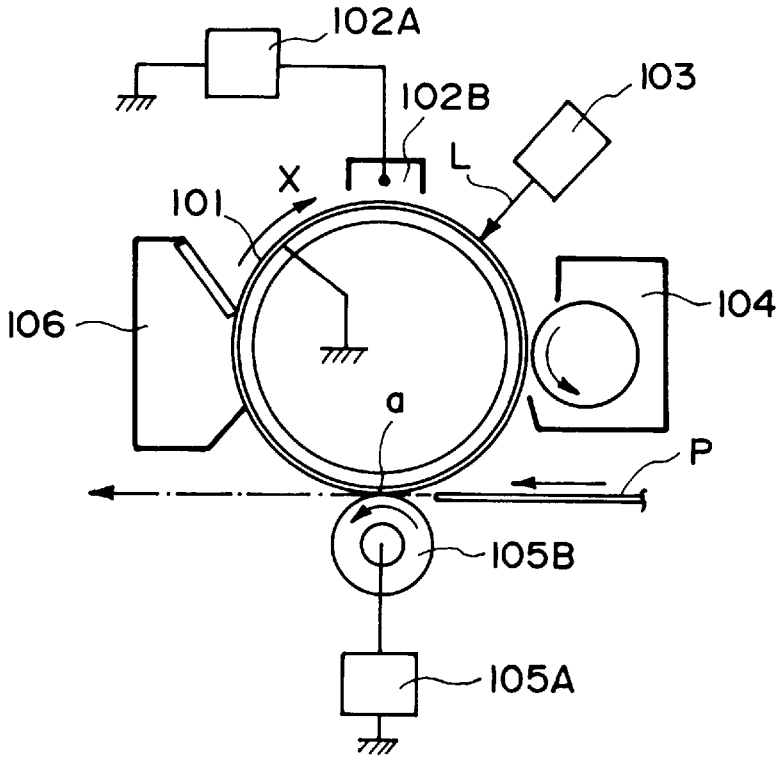
FIG. 12 is a sectional view of an image transfer and reverse development type image forming apparatus of another example.

As shown in FIG. 10, the potential drop Vd in the sheet present part (solid line with solid dot) produced by electric current into the sheet absent part (broken line with white dot) during the transfer operation, is taken into account, and the electric current IDmax so as to assure that even in that case the minimum transfer current Imin=0.5 $\mu$A flows in the sheet passage region (chain line). In other words, during the transfer operation, the transfer roller is constant-current-controlled at IDmax+Imin, and in the part where the photosensitive member and the transfer roller are directly contacted with each other, the current IDmax flows, but in the sheet present part, the current Imin flows. By doing so, even if the minimum size sheet (transfer material) is used, the minimum current of 0.5 $\mu$A is assured in the sheet present part, and therefore, no improper image formation occurs.

By the significant expansion of the latitude of the resistance of the transfer roller, the transfer operation is successfully possible only with the constant-current control without occurrence of the positive memory even if the ambient condition changes.

In place of the transfer roller, a transfer belt or brush is usable.

The rectifying layer 16 functions as a charge injection layer. This will be described in the following. In this embodiment, the structure of the photosensitive drum is the same as with the foregoing embodiment. The peripheral speeds of the charging member in the form of the charging roller and the photosensitive drum, are different during the contact charging operation. The other elements are the same as shown in FIG. 7.

The dispersion of $SnO_2$ in the charge injection layer will be described. If the dispersion amount is too large, the surface resistance of the injection layer becomes too small with the possible result of lateral flow of the latent image charge after the image exposure. Particularly under the high temperature and high humidity condition (H/H), this is remarkable. If it is too small, the $SnO_2$ is not sufficiently exposed at the injection layer surface, with the result that the injection of the charge is not sufficient. If this occurs, local improper charging occurs. Specifically, black dots or an all surface foggy background occurs in the solid white (no image exposure) image in the reverse development apparatus. In order to avoid these problems, as shown in Table 1 below, it is preferable that the amount of dispersion of $SnO_2$ is 2–10% by weight. Here, $SnO_2$ is doped with Sb, and is treated for electric conductivity.

TABLE 1

| $SnO_2$ dispersion | Results |
|---|---|
| 0.2% | Improper charging under any condition |
| 0.5% | Roughened image under L/L |
| 2.0% | Good images |
| 70% | Good images |
| 100% | Good images |
| 120% | "Flow" of image after long run under H/H condition |

L/L condition (15° C., 10%)

H/H condition (32.5° C., 85%)

Here, the conductive filler may be of another metal oxide, conductive carbon or the like. However, in consideration of the desirability of the light reaching the CG layer during the image exposure, $SnO_2$ particles exhibiting good transparency with the light is used in this embodiment. When 70% by weight of $SnO_2$ is dispersed in the phosphazene resin, transmissivity of the injection layer per se was 95% relative to the light having the wavelength of 730 nm. Therefore, the latent image formation is possible by the image exposure without practical problems.

On the other hand, the confirmation test was carried out using the conductive filler of $TiO_2$ particles. From the standpoint of sufficient electric charge injection, 50% by weight $TiO_2$ was dispersed in the binder. When the voltage of −500 V was applied to the charging member, the resultant surface potential of the photosensitive member was −450 V.

However, due to the dispersion of the $TiO_2$ (white particles) in the charge injection layer, the light transmissivity decreased to 50%. In the image exposure process, the light portion potential was −250 V when a laser beam having a wavelength of 730 nm was projected.

In this embodiment, the latent image potential Vd is −450 V while the light portion potential Vl is −250 V, so that the latent image contrast is 200 V, and therefore, the image density without practical problems could be provided. However, if the light transmissivity of the charge injection layer is lower than 50%, the good image is not provided for the following reasons.

When the transmissivity is lower than 50%, the intensity of exposure light has to be increased to provide the same light portion potential. The increase of the exposure light intensity results in remarkable light scattering by the conductive particles in the charge injection layer, and therefore, the latent image is blurred, which is of course undesirable.

The mechanism of the charge injection will be described. In this embodiment, by the provision of the injection layer, the $SnO_2$ particles exposed to the surface, function as an electrode of a capacitor. In other words, if the amount of dispersion is proper, a great number of fine capacitors sandwiching the CT layer 15 as the dielectric member are disposed on the surface of the photosensitive member, in effect, as shown in FIG. 2.

By application of a voltage between the electrodes, and the conductive charging member is contacted, by which the charge can be injected to the electrode, as in a usual capacitor.

For reference, the conventional photosensitive drum without the injection layer does not have such electrodes on the surface of the photosensitive member, or the function of the electrodes occurs only in the trap level, and therefore sufficient electric charge injection occurs.

The charging roller 2 of this embodiment has a resistance of $1\times10^4$, but it is of a two layer structure including an electrically conductive elastic layer on a conductive core metal and a high resistance layer having a higher volume resistivity than the conductive elastic layer. This is effective to prevent the stripe-like improper charging as a result of the lowering of the potential of the roller surface because of the concentration of the charging current to a pinhole, if any, on the photosensitive drum.

With the printer described in the foregoing, the image forming operation has been carried out under the high temperature and high humidity condition (H/H, 32.5° C., 85% RH), under the normal condition (N/N, 23° C., 65% RH), and under the low temperature and low humidity condition (L/L, 15° C., 10% RH). It has been confirmed that good images are provided without improper charging, image blurring, image flow or the like. This method does not use the electric discharge, and therefore, ozone production and the surface roughening of the photosensitive drum hardly occurs.

In order to provide the same charge potential and same image with the conventional photosensitive drum, it is required that the AC charging is carried out by an AC voltage of 2000 V (peak-to-peak voltage) biased with a DC voltage of −500 V. Under this condition, the ozone production was approx. 0.01 ppm, and the surface of the photosensitive member is roughened by the electric discharge, and the charging noise by the oscillating electric field is produced.

As a comparison example, the image forming operation was carried out using the conventional photosensitive drum with the bias condition of this embodiment. It has been confirmed that the surface potential of the photosensitive drum was 0 V, that is, the charging action does not occur.

As described in the foregoing, according to this embodiment, the charging with a low DC voltage without electric discharge is possible, and therefore, the ozone production and AC charging noise can be prevented.

By the electric contact of the contact charging member with the surface of the photosensitive member, the electric charge is injected into the conductive particles at the surface of the photosensitive member. Therefore, even if insulative materials such as dust is present in the nip when they are contacted with each other, or when a defect or the like exists in the contact charging member, the electric charge is not injected, with the result of black dots or the like in the image in the case of the reverse-development.

Particularly, when the charging operation is carried out with the charging roller driven by the photosensitive drum, a point B on the charging roller and a point A on the photosensitive drum are contacted at all times in the nip.

Therefore, if a foreign matter 10 is present in the nip, that portion is always charged properly. Thus, if the charging roller has a defect, the improper charging occurs at the interval of the charging roller rotation.

In this embodiment, there is provided a peripheral speed difference between the photosensitive drum and the charging member at the nip between the photosensitive member and the charging roller or the charging brush.

Because of this, it can be avoided that a point of the photosensitive drum is contacted to different points of the contact charging member in the nip, thus preventing partial charge improperness. On the other hand, when the photosensitive drum is rotated with the charging roller or charging brush being fixed, the charge potential lowers as compared with the foregoing embodiment, and therefore, the proper charging is not effected.

Figure 16:
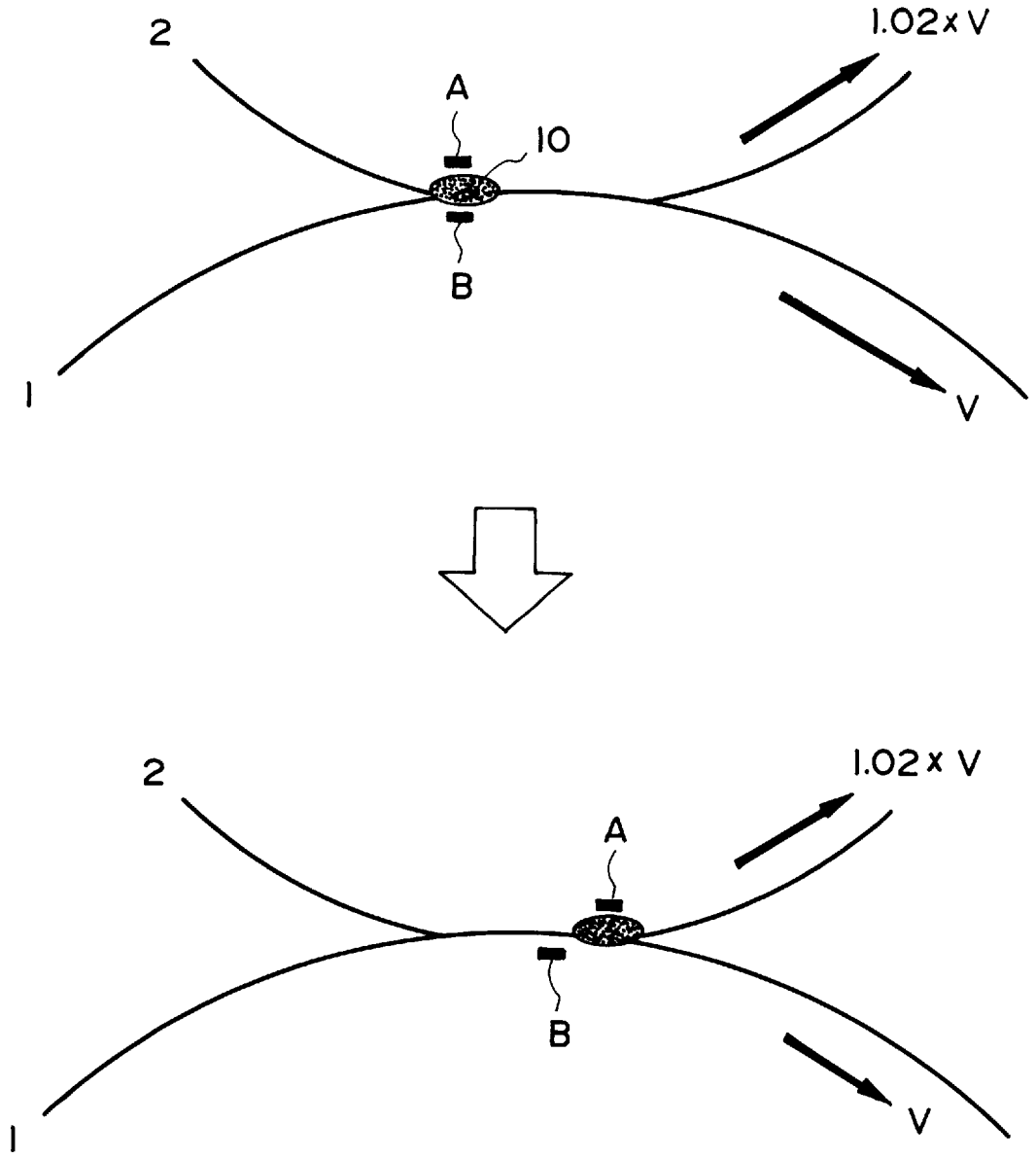

FIG. 16 shows an example in which the charging roller is driven. It is driven through a gear coaxially provided with the photosensitive drum and a gear mounted on the core metal of the charging roller. By changing the gear ratio, the charging roller is rotated at a peripheral speed higher by 2%. By doing so, when foreign matter such as dust is brought into the nip, or when the charging roller has a defect, a point on the photosensitive drum is given an opportunity to be contacted to a certain range of the conductive charging roller in the nip, and therefore, the improper charging can be avoided. In this embodiment, the OPC photosensitive member comprises a charge transfer layer (CT layer) of p-type semiconductor on an electrically conductive base, a charge generating layer, and a charge injection layer in this order (function layers) it is charged to the positive polarity by the contact charging member.

However, when the positive charging is effected to a conventional photosensitive member using a p-type semiconductor, the positive charge on the surface of the photosensitive member provided by the charging process, is capable of passing through the p-type semiconductor having the positive holes, and therefore, it is instantaneously discharged (charge removal), and therefore, it is difficult to retain the charged potential.

According to this embodiment, however, by the provision of the surface charge injection layer, the positive charge retaining power is enhanced, and therefore, it becomes possible to retain the charged potential for the period of time practical in the electrophotographic process. In order to enhance this effect, it is effective to sandwich a resistance layer (UC layer in the first embodiment) between the conductive base and the charge transfer layer, thus preventing escape of the positive charge into the conductive base.

Figure 17:
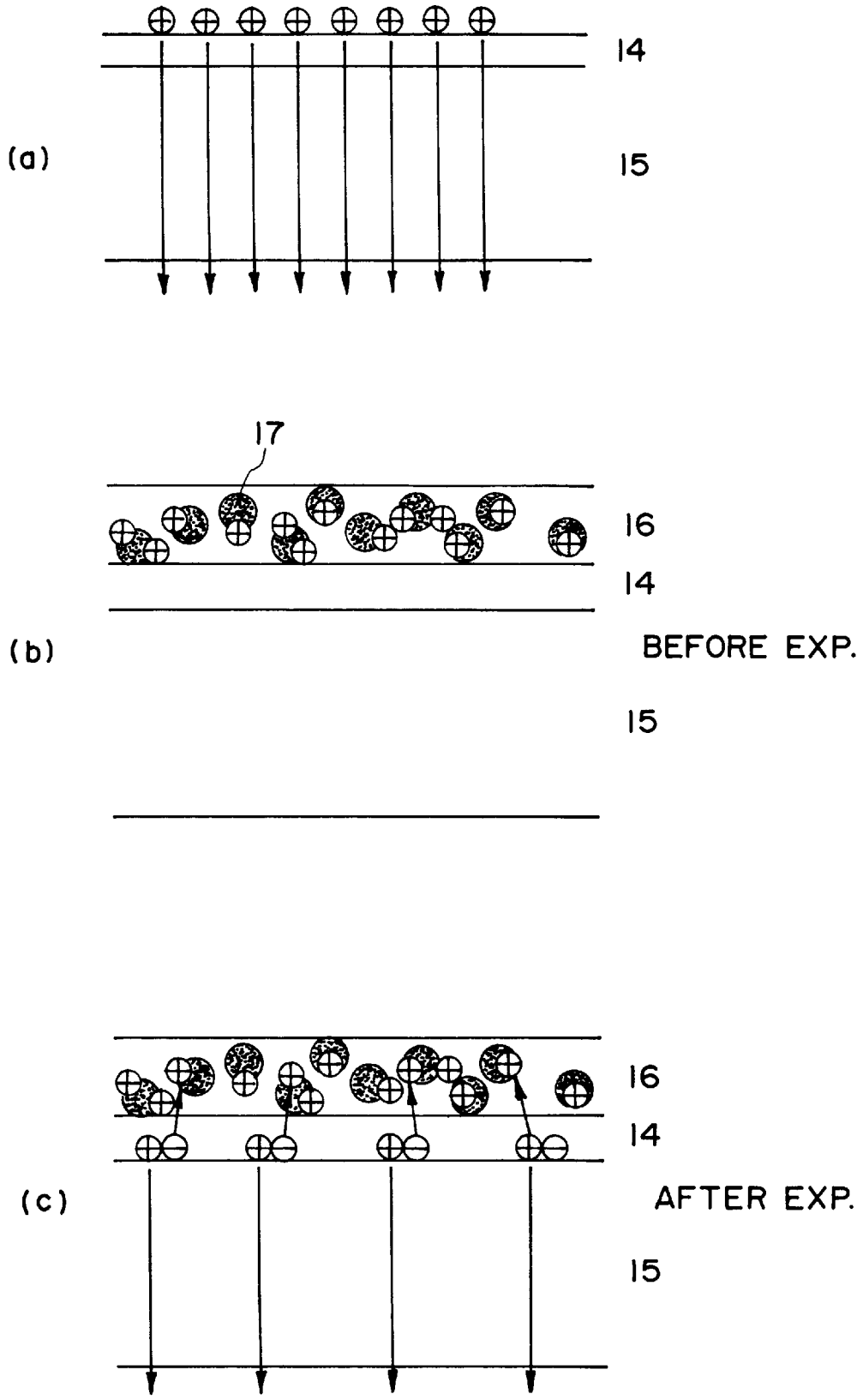
FIG. 17 is a sectional view illustrating motion of electric charge.

Referring to FIG. 17 (FIG. 17, (a), FIG. 17, (b) and FIG. 17, (c), there is shown motion of the electric charge in the charging and exposure process. FIG. 17(b) deals with the charging of the photosensitive drum without the injection layer (conventional). When the positive charging is effected using a corona charger, or contact charging device using electric discharge, the positive charge is placed on the CT layer surface. However, the positive charge is unable to move in the CT layer which is a p-type semiconductor, and therefore, the charged potential is not retained.

FIG. 17, (b) deals with the motion of the electric charge in the photosensitive drum according to this embodiment. The direct charge injection by the contact charging member, the positive charge moves into the conductive filler in the charge injection layer at the photosensitive layer surface. However, in the interface between the charge injection layer and the CT layer, there is a difference in the energy level such as work function or the like, and therefore, the positive charge is not easily released through the CT layer, and therefore, the charged potential is retained for a certain period of time. By the provision of the UC layer, this effect can be further enhanced.

As shown in FIG. 17, (c), couples of positive and negative electric charges generated in the charge generating layer by the exposure to light in the exposure process, are moved by the electric field, and the negative charges neutralize the positive charge in the charge injection layer. On the other hand, the positive charges are released to the conductive base through the charge transfer layer, so that the surface potential of the exposed part decreases. The energy level is considered in the conventional manner for the junction surfaces between the CG layer and the CT layer so as to permit easy motion of the positive charge.

Figure 18:
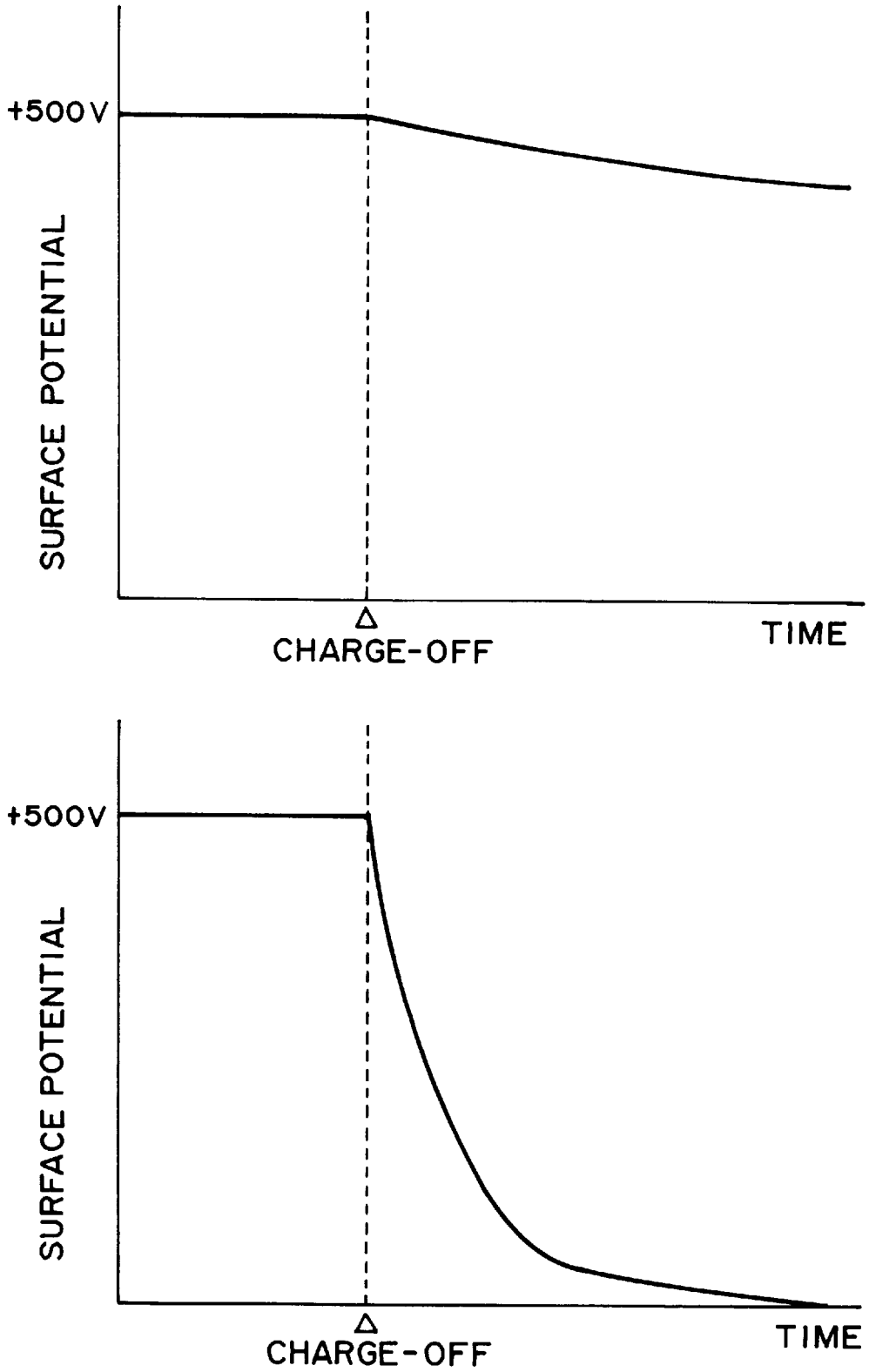
FIG. 18 are graphs showing motion of the electric charge in a conventional photosensitive member and a photosensitive member according to this invention.

FIG. 18 shows the surface potential of the photosensitive drum appearing in the photosensitive drum of this embodiment and in the conventional photosensitive drum, when the positive charging is carried out. In order to compare the charge retaining power of the positive charge when the measuring condition is the same, the charging was carried out by the AC contact charging.

As will be apparent from this Figure, in the photosensitive drum of this embodiment, it is possible to retain the positive charge when the p-type semiconductor is used.

Thus, in the contact type charging process with low voltage, the positive charging can be effected to the OPC photosensitive member using a p-type semiconductor.

As described in the foregoing, a charge injection layer for retaining the electric charge on the photosensitive member is formed, and the charge is injected directly by the contact charging member, for the purpose of electric charging.

However, if the low resistance layer is simply formed on the surface of the photosensitive layer, the electric charge laterally flows in the surface, with the result that the electrostatic latent image can not be retained. In an embodiment, the photosensitive member has a structure exhibiting such an anisotropic nature that the surface resistance is high, but the resistance is low toward the inside of the photosensitive drum.

In an example of such a structure, a proper amount of conductive particles having the light transmissivity ($SnO_2$, for example) is dispersed in the insulative binder, by which the above-described anisotropic conductivity can be provided.

In addition, the charge injection layer is capable of retaining electric charge, irrespective of the positive and negative polarities, and therefore, when a function separation type photosensitive member such as OPC or the like is used, it is possible to form positive or negative latent image by changing the order of lamination of the charge generating layer and the charge transfer layer.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic apparatus, comprising:

a movable photosensitive member having a photoconductive layer;

image forming means for forming an image on said photosensitive member, said image forming means including a charging member for applying electric charge to said photosensitive member; and a transfer member cooperating with said photosensitive member to form a nip to transfer the image from said photosensitive member onto a transfer material said transfer member applying, to the transfer material, electric charge of a polarity opposite from a charging polarity of said charging member;

wherein said photosensitive member is provided with a surface layer on said photoconductive layer, wherein a pn-junction is formed between said surface layer and said photoconductive layer to prevent the electric charge applied by said transfer member from entering said photoconductive layer and to permit the electric charge applied by said charging member to enter said photoconductive layer, and wherein said transfer member is constant-current-controlled during image transfer onto the transfer material.

2. An apparatus according to claim 1, wherein said image forming means forms a toner image on said photosensitive member.

3. An apparatus according to claim 1, wherein said transfer member is contactable to said photosensitive member.

4. An apparatus according to claim 2, wherein said image forming means includes image exposure means for exposing said photosensitive member having been charged by said charging member to image light to form a latent image having a polarity opposite from a charging polarity of said transfer member.

5. An apparatus according to claim 1, wherein said surface layer comprises a binder material doped with a semiconductor material of a type which is different from a type of said photoconductive layer.

6. An apparatus according to claim 5, wherein said surface layer comprises a binder material and electrically conductive particles dispersed therein.

7. An apparatus according to claim 1, wherein said transfer member has a resistance of not more than $5\times10^9$ ohm.

8. An apparatus according to claim 6, wherein said surface layer comprises the binder material and 2–100 parts by weight of the conductive particles per 100 parts of the binder material.

9. An apparatus according to claim 1, wherein said surface layer has light transmissivity of not less than 50%.

10. An apparatus according to claim 1, wherein said charging member is contactable to said photosensitive member.

11. An apparatus according to claim 10, wherein said charging member is movable while rubbing said photosensitive member.

12. An apparatus according to claim 1, wherein a peripheral speed of said charging member is higher than a peripheral speed of said photosensitive member in a nip formed between said charging member and said photosensitive member.

13. An apparatus according to claim 3, wherein said transfer member is in the form of a roller.

14. An apparatus according to claim 10 or 11, wherein said charging member is in the form of a roller.

15. An apparatus according to claim 2, wherein said transfer means applies the electric charge of the opposite polarity to said photosensitive member in a region where the transfer material is not in a transfer position.

16. An apparatus according to claim 2, wherein said transfer means applies the electric charge of the opposite polarity to said photosensitive member when the toner image is transferred onto the transfer material.

17. An apparatus according to claim 1, wherein said photoconductive layer includes a charge transfer layer and a charge generating layer inside said charge transfer layer.

* * * * *

UNITED STATES PATENT AND TRADEMARK OFFICE

CERTIFICATE OF CORRECTION

PATENT NO. : 5,809,379

DATED : September 15, 1998

INVENTOR(S) : HIDEYUKI YANO ET AL.

It is certified that error appears in the above-identified patent and that said Letters Patent is hereby corrected as shown below:

[54] TITLE

"ELECTROPHOTOGRAPHY" should read --ELECTROPHOTOGRAPHIC APPARATUS--.

COLUMN 1

Line 1, "ELECTROPHOTOGRAPHY" should read --ELECTROPHOTOGRAPHIC APPARATUS--.
Line 37, "is" should read --is an--.
Line 52, "reverse developed" should read --reverse-developed--.

COLUMN 3

Line 45, "of the image transfer and reverse development type." should be deleted.

COLUMN 4

Line 7, "period" should read --period,--.
Line 20, "important" should read --the important--.
Line 40, "increase," should read --increases,--.
Line 54, "period," should read --period--.

COLUMN 6

Line 48, "disclose" should read --disclosed--.

UNITED STATES PATENT AND TRADEMARK OFFICE

CERTIFICATE OF CORRECTION

PATENT NO. : 5,809,379

DATED : September 15, 1998

INVENTOR(S) : HIDEYUKI YANO ET AL.

It is certified that error appears in the above-identified patent and that said Letters Patent is hereby corrected as shown below:

COLUMN 8

Line 36, "image" should read --image is--.

COLUMN 10

Line 5, "combined" should read --is combined--.

COLUMN 11

Line 45, "as" should read --is--.

Line 51, "property" should read --property can be used--.

COLUMN 12

Line 8, "are" should read --is--.

COLUMN 15

Line 48, "materials" should read --material--.

COLUMN 16

Line 40, "(c)," should read --(c)),--.
Line 65, "charge" should read --charges--.

UNITED STATES PATENT AND TRADEMARK OFFICE

CERTIFICATE OF CORRECTION

PATENT NO. : 5,809,379

DATED : September 15, 1998

INVENTOR(S) : HIDEYUKI YANO ET AL.

It is certified that error appears in the above-identified patent and that said Letters Patent is hereby corrected as shown below:

COLUMN 17

Line 39, "form" should read --form a--.
Line 57, "material" should read --material,--.

COLUMN 18

Line 42, "claim 1," should read --claim 11,--.

Signed and Sealed this

Twenty-seventh Day of July, 1999

*Attest:*

Q. TODD DICKINSON

*Attesting Officer*

*Acting Commissioner of Patents and Trademarks*